US009562689B2

(12) United States Patent
Stewart et al.

(10) Patent No.: US 9,562,689 B2
(45) Date of Patent: Feb. 7, 2017

(54) SEAL FOR FUEL DISTRIBUTION PLATE

(71) Applicant: General Electric Company, Schenectady, NY (US)

(72) Inventors: Jason Thurman Stewart, Greer, SC (US); Christopher Paul Keener, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 1127 days.

(21) Appl. No.: 13/720,118

(22) Filed: Dec. 19, 2012

(65) Prior Publication Data

US 2014/0083110 A1 Mar. 27, 2014

Related U.S. Application Data

(63) Continuation-in-part of application No. 13/593,123, filed on Aug. 23, 2012.

(51) Int. Cl.

| | |
|---|---|
| ***F23D 14/64*** | (2006.01) |
| ***F23R 3/28*** | (2006.01) |
| ***F23R 3/10*** | (2006.01) |

(52) U.S. Cl.

CPC ..... *F23R 3/286* (2013.01); *F23R 3/10* (2013.01); *F23R 3/283* (2013.01)

(58) Field of Classification Search

CPC ..... F23R 3/28; F23R 3/283; F23R 3/286; F23R 3/60; F23R 2900/00012; F23R 2900/00017; F23R 3/10; F23D 14/62

See application file for complete search history.

(56) References Cited

U.S. PATENT DOCUMENTS

| | | | | |
|---|---|---|---|---|
| 3,552,754 | A | 1/1971 | Bow | |
| 3,995,332 | A | 12/1976 | Forchini et al. | |
| 4,373,580 | A | 2/1983 | Gossalter | |
| 4,712,370 | A * | 12/1987 | MacGee | 60/785 |
| 5,482,296 | A | 1/1996 | Peppiatt et al. | |
| 5,987,879 | A | 11/1999 | Ono | |
| 6,883,804 | B2 | 4/2005 | Cobb | |
| 6,962,330 | B2 | 11/2005 | Klitsch | |
| 7,134,669 | B2 | 11/2006 | Uhrner | |
| 7,464,940 | B2 | 12/2008 | Datta | |
| 2004/0245729 | A1 | 12/2004 | Bock | |
| 2007/0012043 | A1 * | 1/2007 | Parker et al. | 60/752 |

(Continued)

*Primary Examiner* — William H Rodriguez
*Assistant Examiner* — Thomas Burke
(74) *Attorney, Agent, or Firm* — Nixon & Vanderhye P.C.

(57) ABSTRACT

A fuel flow passes through a micromixer section of a gas turbine that includes a plurality of mixing tubes for transporting a fuel/air mixture and a distribution plate including a plurality of distribution holes and a plurality of tube holes for accommodating the mixing tubes. Each of the mixing tubes includes a plurality of fuel holes through which fuel enters the mixing tubes. The tube holes and the mixing tubes form a plurality of annulus areas between the distribution plate and the mixing tubes. The distribution holes and the annulus areas are configured to pass the fuel flow through the distribution plate toward the fuel holes. A flow management device modifies an effective size of the annulus areas to control a distribution of the fuel flow through the distribution holes and the annulus areas of the distribution plate to provide a uniform fuel/air composition in each of the mixing tubes.

23 Claims, 26 Drawing Sheets

(56) References Cited

U.S. PATENT DOCUMENTS

| | | | | |
|---|---|---|---|---|
| 2008/0053097 | A1* | 3/2008 | Han et al. | 60/737 |
| 2009/0072455 | A1 | 3/2009 | McPherson | |
| 2009/0166984 | A1 | 7/2009 | Matsui et al. | |
| 2010/0207332 | A1 | 8/2010 | Smith | |
| 2010/0218501 | A1* | 9/2010 | York et al. | 60/737 |
| 2010/0300116 | A1 | 12/2010 | Kaleeswaran et al. | |
| 2011/0057056 | A1* | 3/2011 | Ziminsky | F23D 14/48<br>239/398 |
| 2011/0073684 | A1* | 3/2011 | Johnson | F23D 14/02<br>239/553.5 |
| 2011/0083439 | A1* | 4/2011 | Zuo | F23D 14/64<br>60/737 |
| 2012/0055167 | A1* | 3/2012 | Johnson | F01D 9/023<br>60/776 |
| 2012/0058437 | A1* | 3/2012 | Uhm | F23D 14/62<br>431/9 |
| 2012/0180487 | A1* | 7/2012 | Uhm | F23D 14/62<br>60/737 |

* cited by examiner

SEAL FOR FUEL DISTRIBUTION PLATE

CROSS-REFERENCE TO APPLICATION

The application is a continuation-in-part of U.S. patent application Ser. No. 13/593,123, filed Aug. 23, 2012, pending, which is incorporated herein by reference in its entirety.

FIELD OF THE INVENTION

The present technology relates generally to gas turbines and more particularly to a device for controlling fuel flow through a distribution plate in a combustor of a gas turbine.

BACKGROUND OF THE INVENTION

Gas turbine engines typically include a compressor for compressing incoming air, a combustor for mixing fuel with the compressed air and igniting the fuel/air mixture to produce a high temperature gas stream, and a turbine section that is driven by the high temperature gas stream. The fuel is typically mixed with the compressed air in a micromixer. Nitrogen oxides may be minimized when a uniform composition of the fuel/air mixture is maintained. Further, turbine efficiency may be enhanced by keeping constant the composition of the fuel/air mixture. Thus, it is desired to effectively control distribution of the fuel to the mixing tubes so as to maintain a uniform composition of the fuel/air mixture in each of the mixing tubes.

Turbine operation is directly affected by fluid mechanics and distribution of the fuel flow through the micromixer. As such, turbine operation can be enhanced by more effectively controlling the fuel flow through the micromixer.

BRIEF SUMMARY OF THE INVENTION

One exemplary but nonlimiting aspect of the disclosed technology relates to a method of controlling a flow rate and/or a distribution of a fuel flow through a distribution plate of a gas turbine to affect distribution of the fuel flow to a plurality of fuel holes.

Another exemplary but nonlimiting aspect of the disclosed technology relates to a flow management device situated near an annulus area formed between a mixing tube and a distribution plate to control the flow rate of a fuel flow through the annulus area.

In one exemplary but nonlimiting embodiment, there is provided a gas turbine comprising a plurality of mixing tubes arranged to transport a fuel/air mixture to a reaction zone for ignition, wherein each mixing tube includes a plurality of fuel holes through which fuel enters the mixing tubes. A plate has a plurality of tube holes formed therein, wherein the tube holes are configured to accommodate the mixing tubes thereby forming a plurality of annulus areas between the plate and the mixing tubes, and the annulus areas are configured such that the fuel flows through the annulus areas. The fuel holes are arranged on a downstream side of the plate with respect to the fuel flow. The turbine further comprises a flow management device that engages at least one of the plate and the mixing tubes and includes a portion situated within the annulus areas to control a distribution of the fuel to the fuel holes.

In another exemplary but nonlimiting embodiment, there is provided a method of controlling fuel flow through a plate in a gas turbine, wherein the plate includes a plurality of through-holes and a plurality of tube holes formed therein, the tube holes are adapted to accommodate a plurality of mixing tubes with which the tube holes form a plurality of annulus areas, and the plurality of mixing tubes are arranged to transport a fuel/air mixture to a reaction zone for ignition. The method comprises establishing a fuel flow adapted to pass through the through-holes and the annulus areas, adjusting an effective size of the annulus areas to control a distribution of the fuel flow through the through-holes and the annulus areas of the plate, and mixing the fuel flow with air in the plurality of mixing tubes to form the fuel/air mixture.

In still another exemplary but nonlimiting embodiment, there is provided a micromixer for mixing fuel and air in a gas turbine. The micromixer comprises an inlet through which fuel enters a section of the micromixer, a plate situated in the section and including a plurality of holes formed therein such that the fuel flows through the plurality of holes. A plurality of mixing tubes extends through a first portion of the plurality of holes to transport a fuel/air mixture to a reaction zone for ignition. The first portion of holes forming a plurality of annulus areas between the plate and the mixing tubes, wherein each mixing tube includes a plurality of fuel holes through which fuel enters the mixing tubes. Further, a flow management device engages at least one of the plate and the mixing tubes to control a flow rate of the fuel flow through the first portion of holes.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
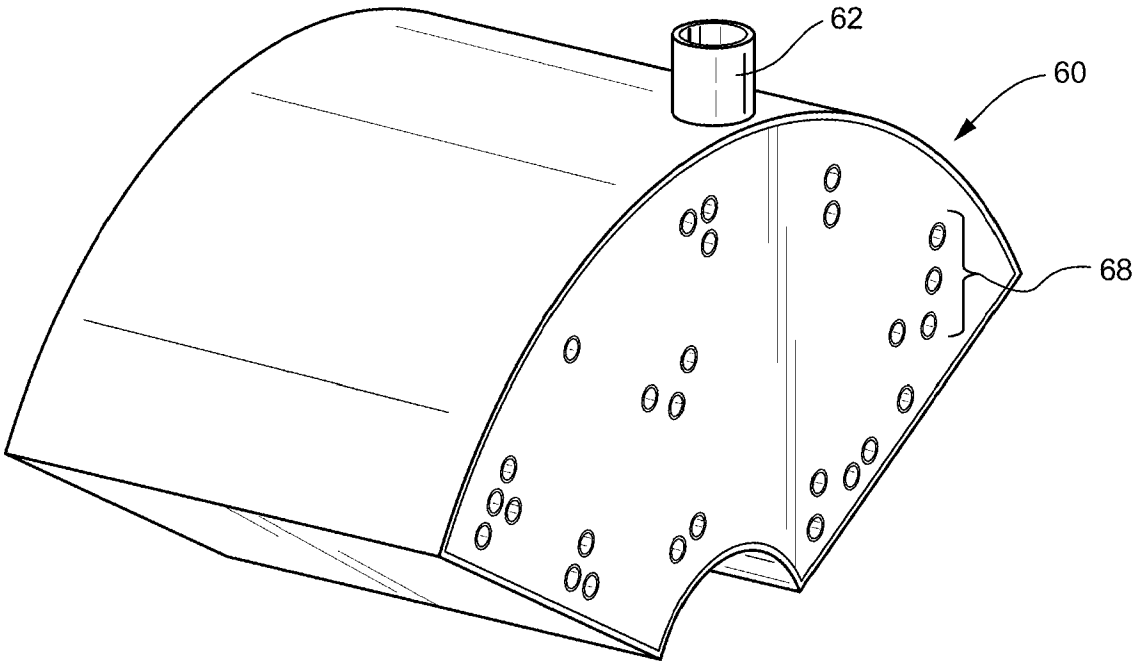
FIG. 1 is a perspective view of part of a micromixer according to an example of the disclosed technology.
Figure 2:
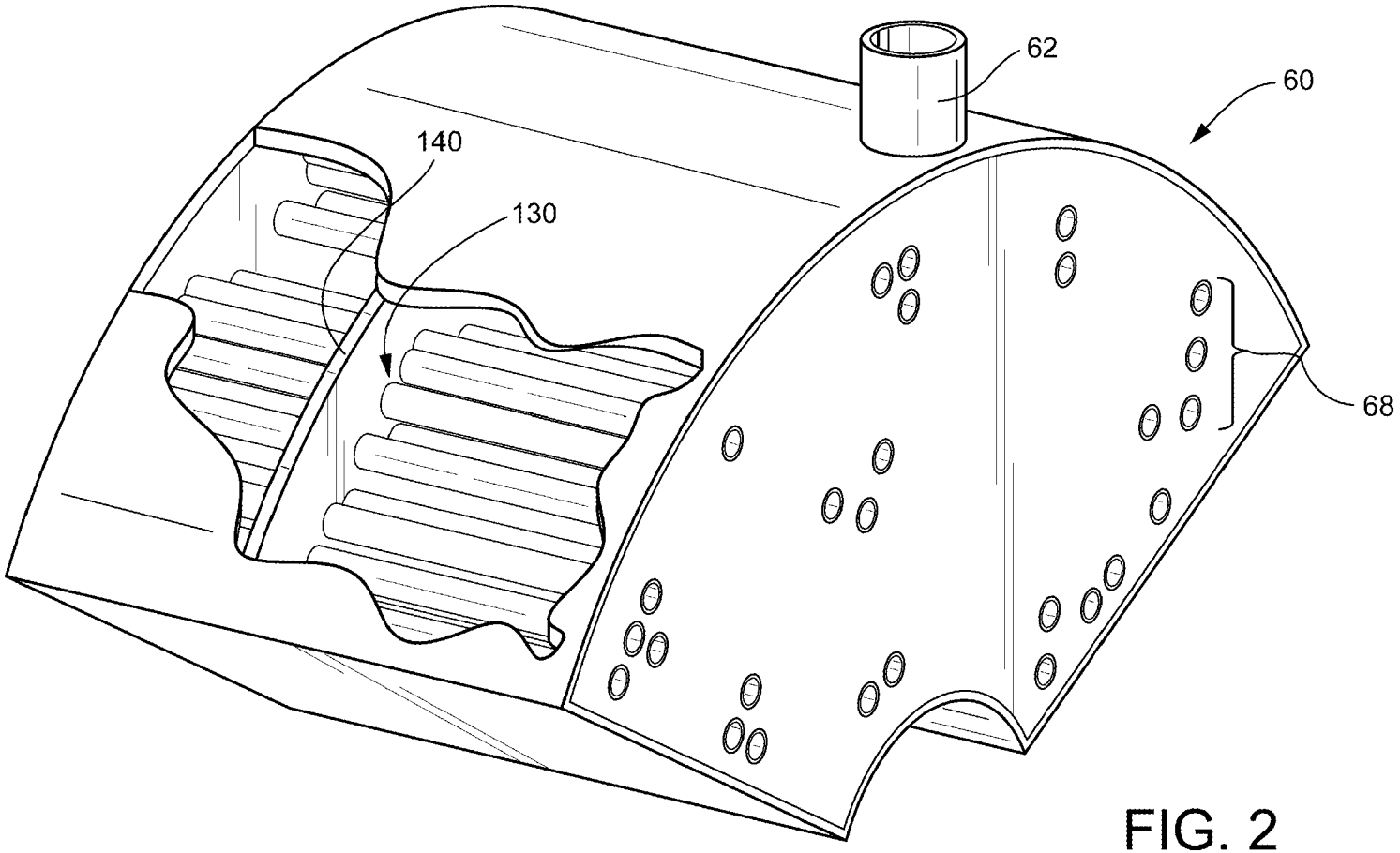
FIG. 2 is a perspective view similar to FIG. 1 showing a partial cutaway portion of the micromixer.
Figure 3:
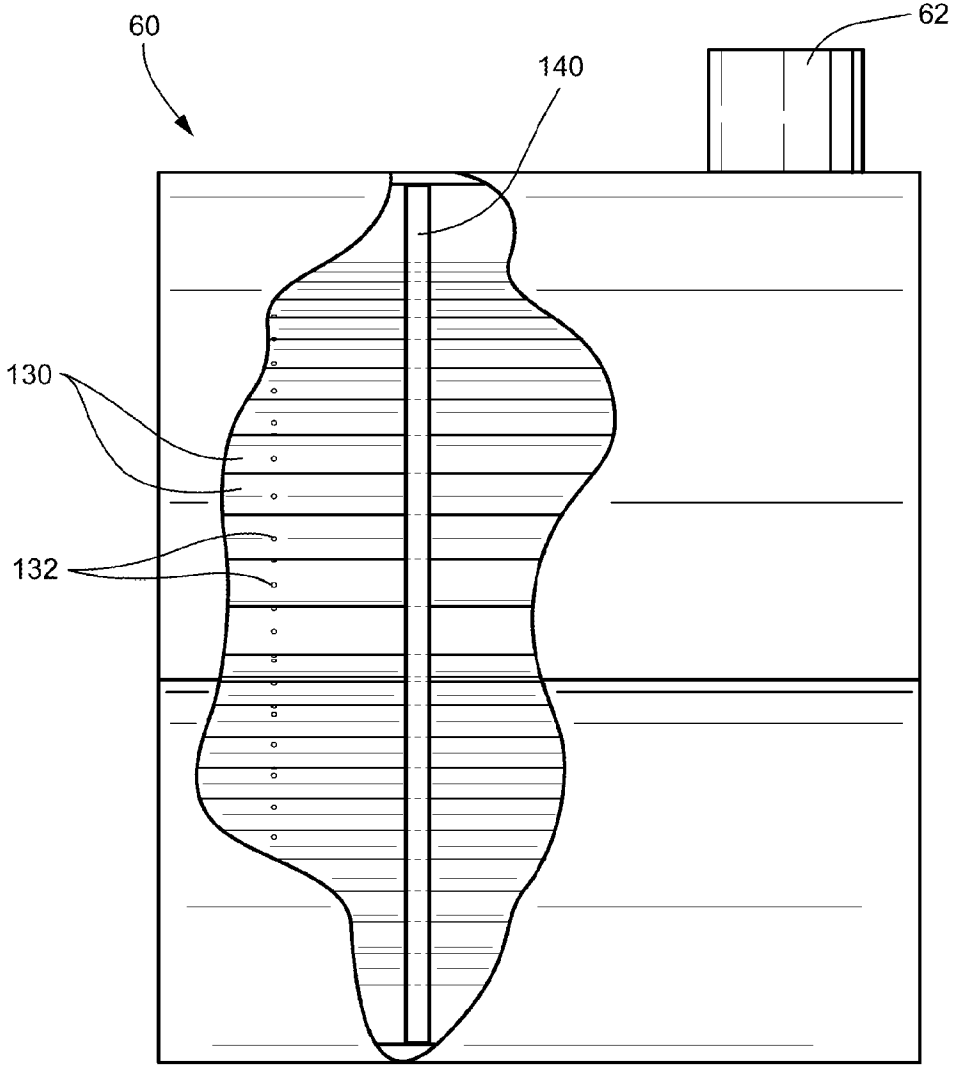
FIG. 3 is a side view of the micromixer of FIG. 1 showing a partial cutaway portion of the micromixer.

Referring to FIGS. 1 and 2, a section of a micromixer 60 is shown. Fuel and air are mixed together in the micromixer 60. The fuel/air mixture 135 exits the micromixer through fuel/air mixture outlets 68 and is transported to a reaction zone or combustion chamber where the fuel/air mixture 135 is ignited to create mechanical energy.

A plurality of mixing tubes 130 extends through the micromixer 60 to transport the fuel/air mixture 135 to a reaction zone for ignition. A fuel flow 110 enters the micromixer 60 through inlet 62 and travels over an exterior portion of the mixing tubes 130 to an upstream portion of the mixing tube where the fuel flow 110 mixes with air 120 already present in the mixing tubes 130 to form the fuel/air mixture 135. The fuel flow 110 enters the mixing tubes via fuel holes 132 formed in the mixing tubes. A distribution plate 140 is situated in the micromixer 60 between the fuel inlet 62 and the fuel holes 132 such that the fuel flow 110 passes through the distribution plate 140 to reach the fuel holes 132.

Figure 4:
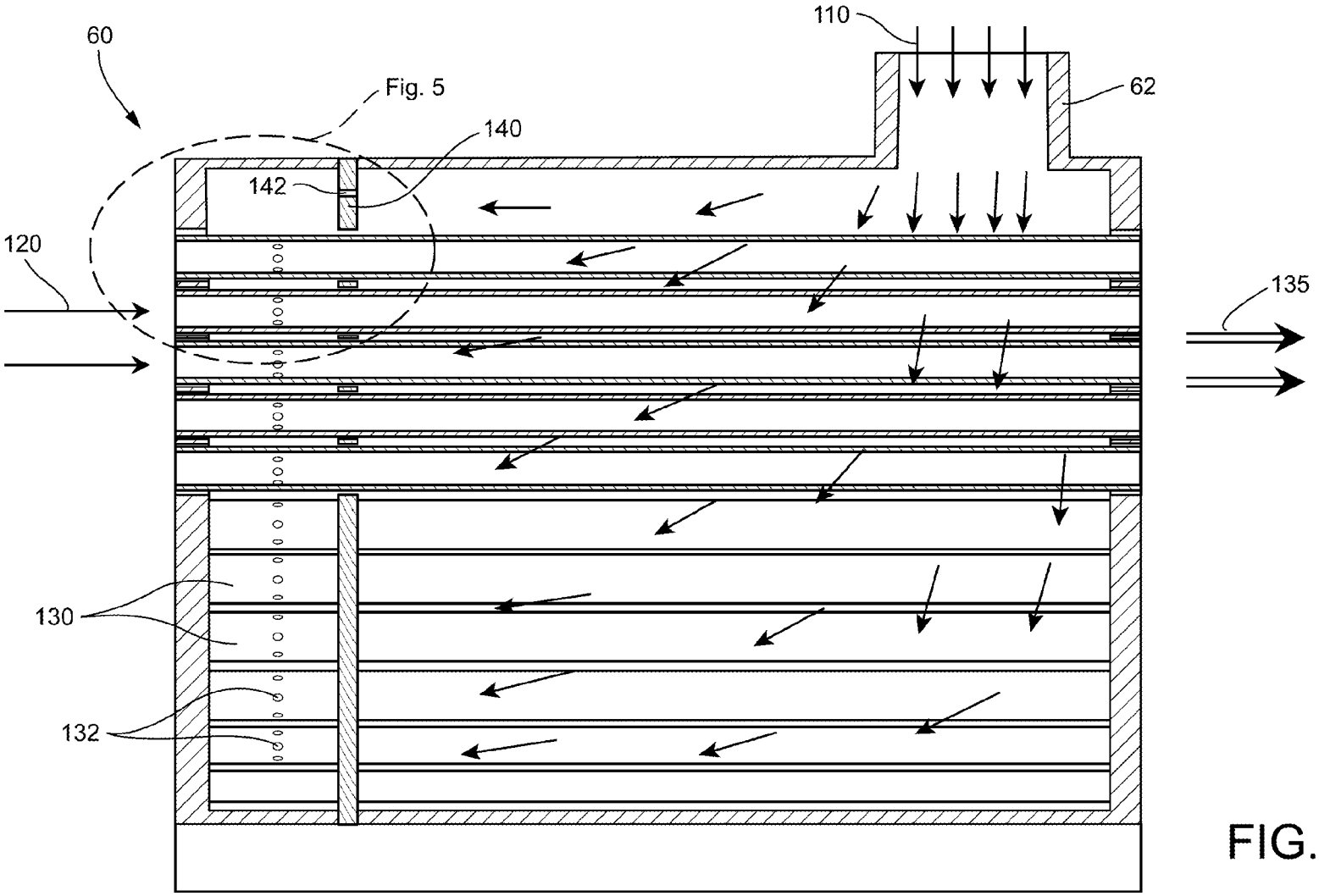
FIG. 4 is a schematic representation of a cross-section of the micromixer of FIG. 1.
Figure 5:
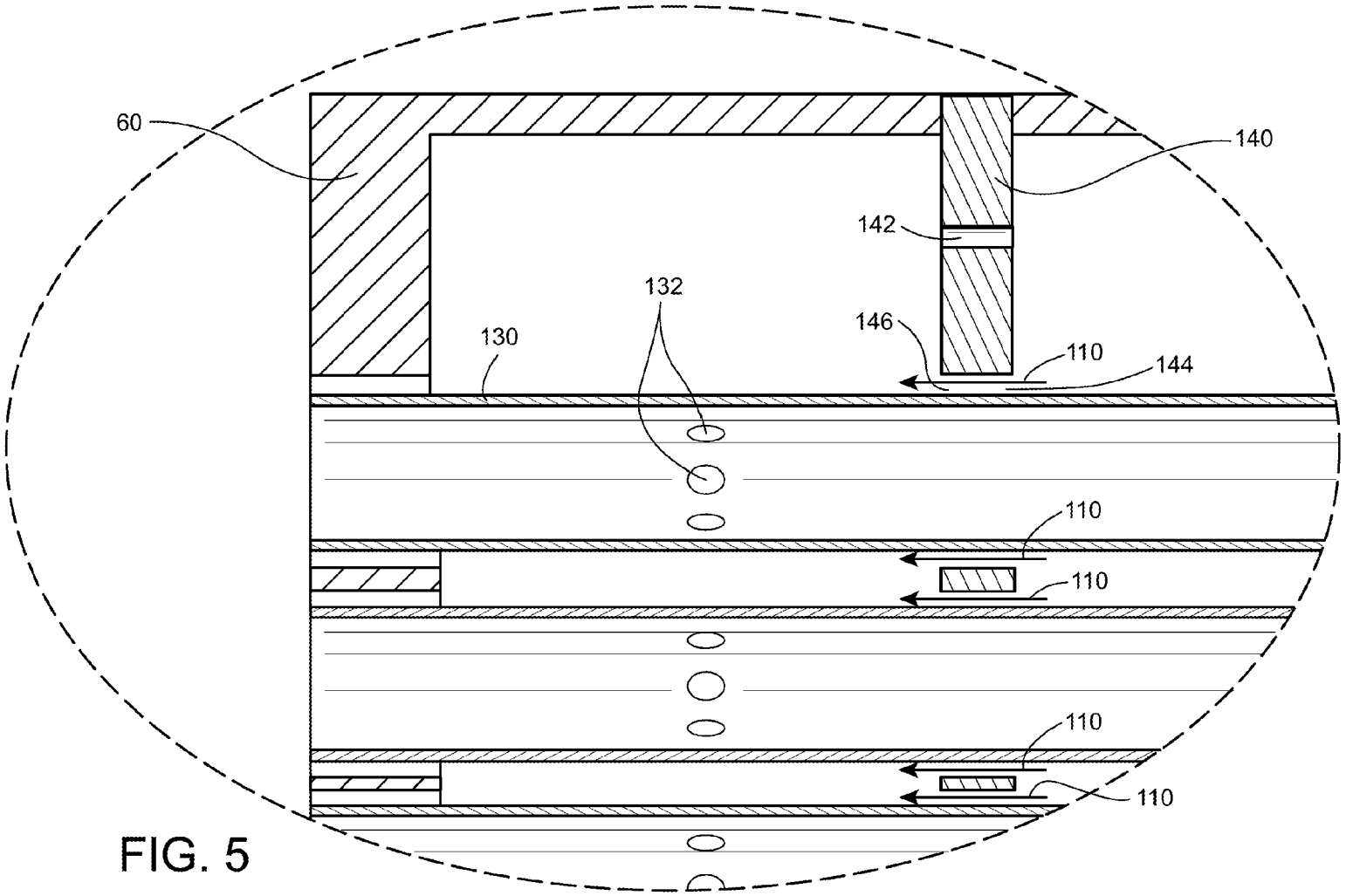
FIG. 5 is an enlarged detail taken from FIG. 4.
Figure 6:
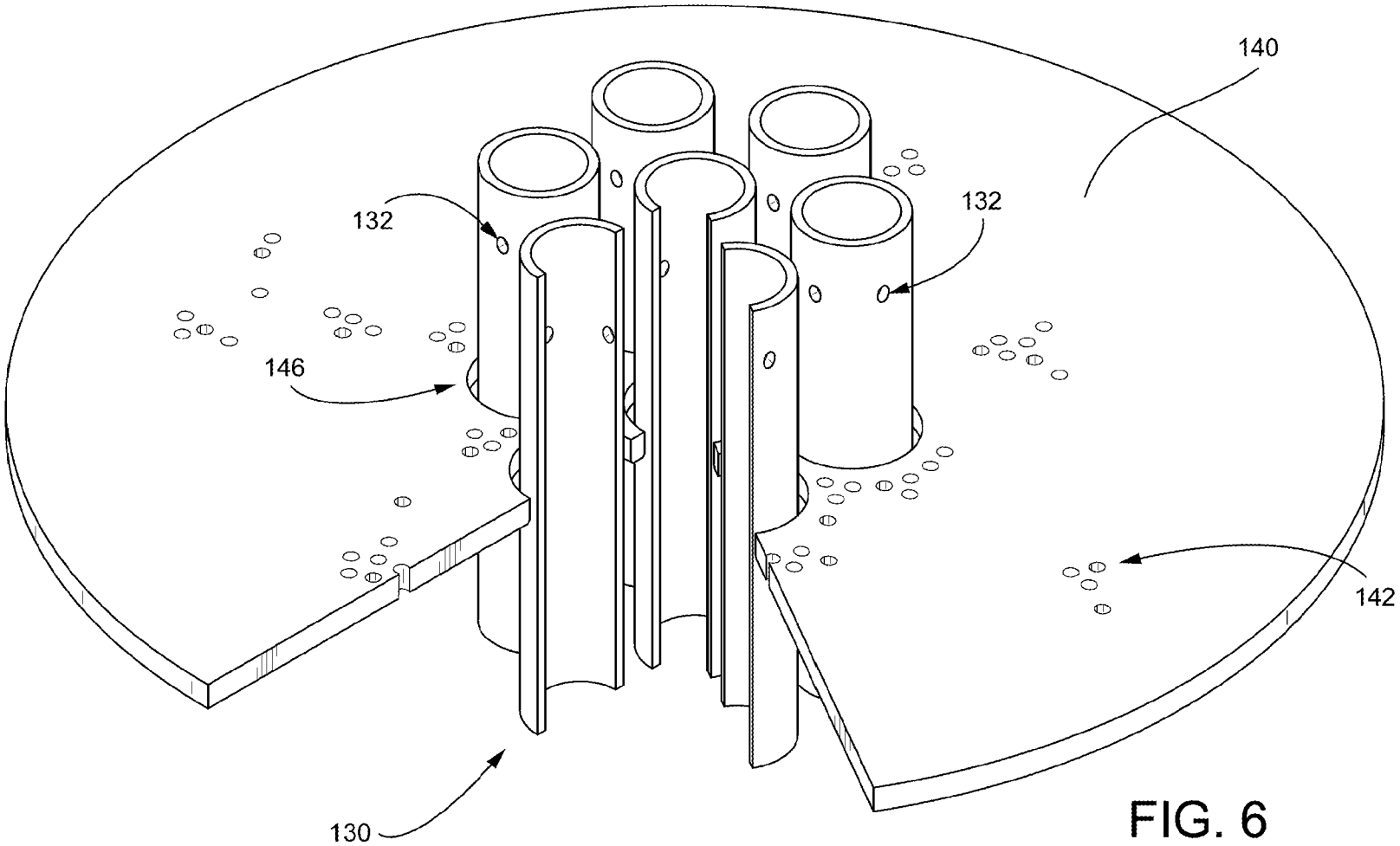
FIG. 6 is a perspective view of a distribution plate and a plurality of mixing tubes according to an earlier configuration known to applicants.
Figure 7:
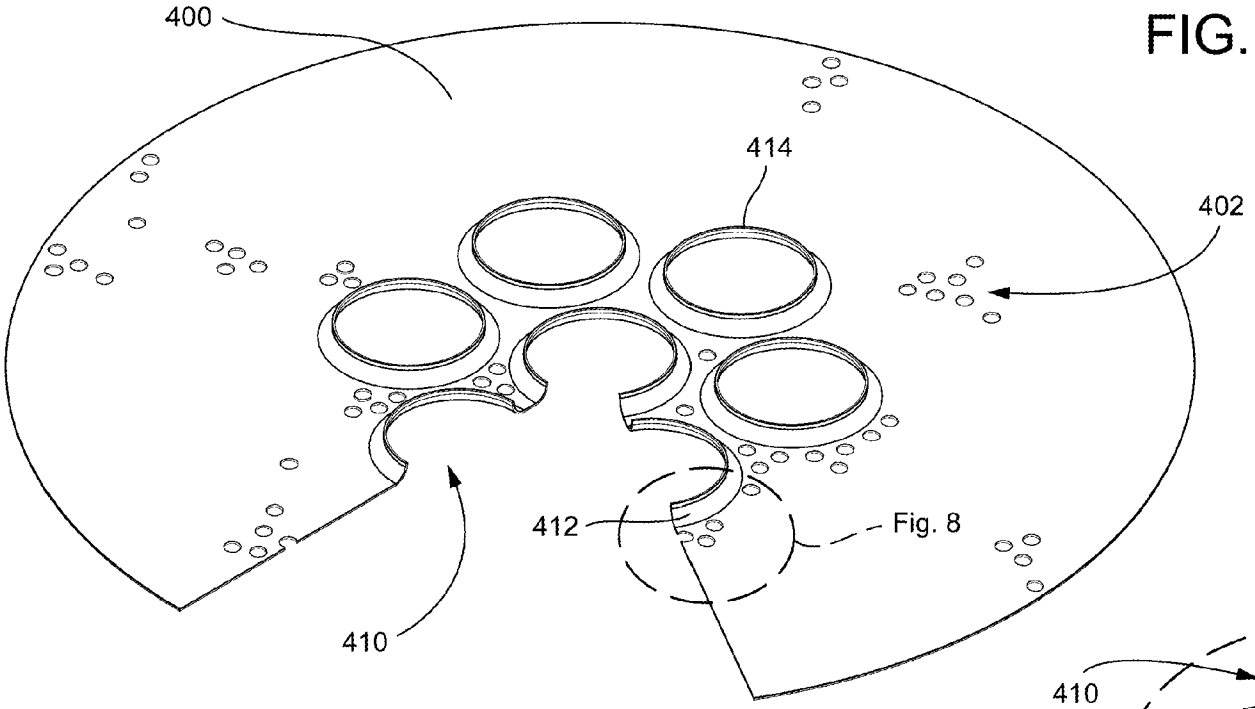
FIG. 7 is a perspective view of a sealing plate according to a first example of the disclosed technology.
Figure 8:
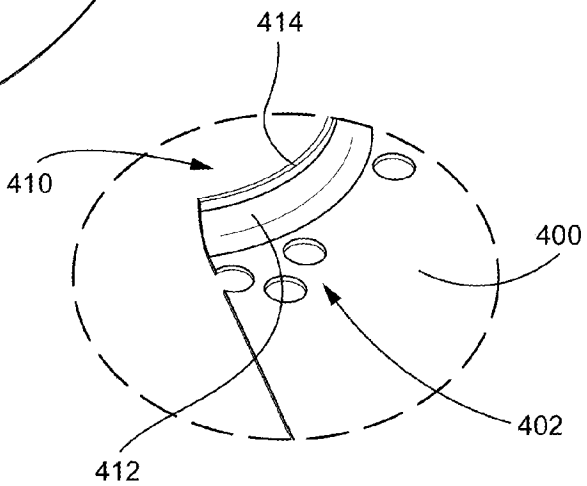
FIG. 8 is an enlarged detail taken from FIG. 7.
Figure 9:
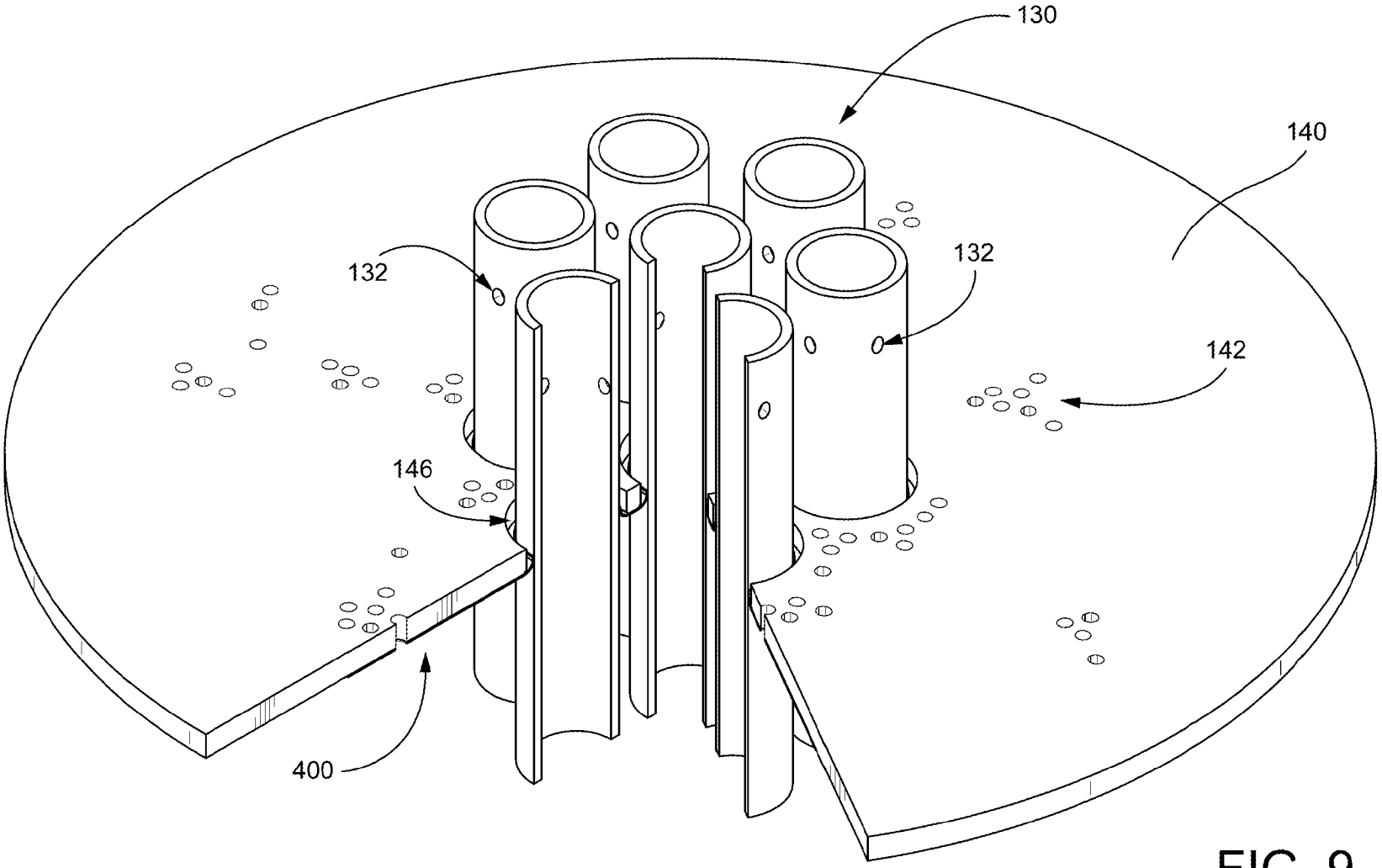
FIG. 9 is a perspective view of a distribution plate assembly including the sealing plate of FIGS. 7 and 8.
Figure 10:
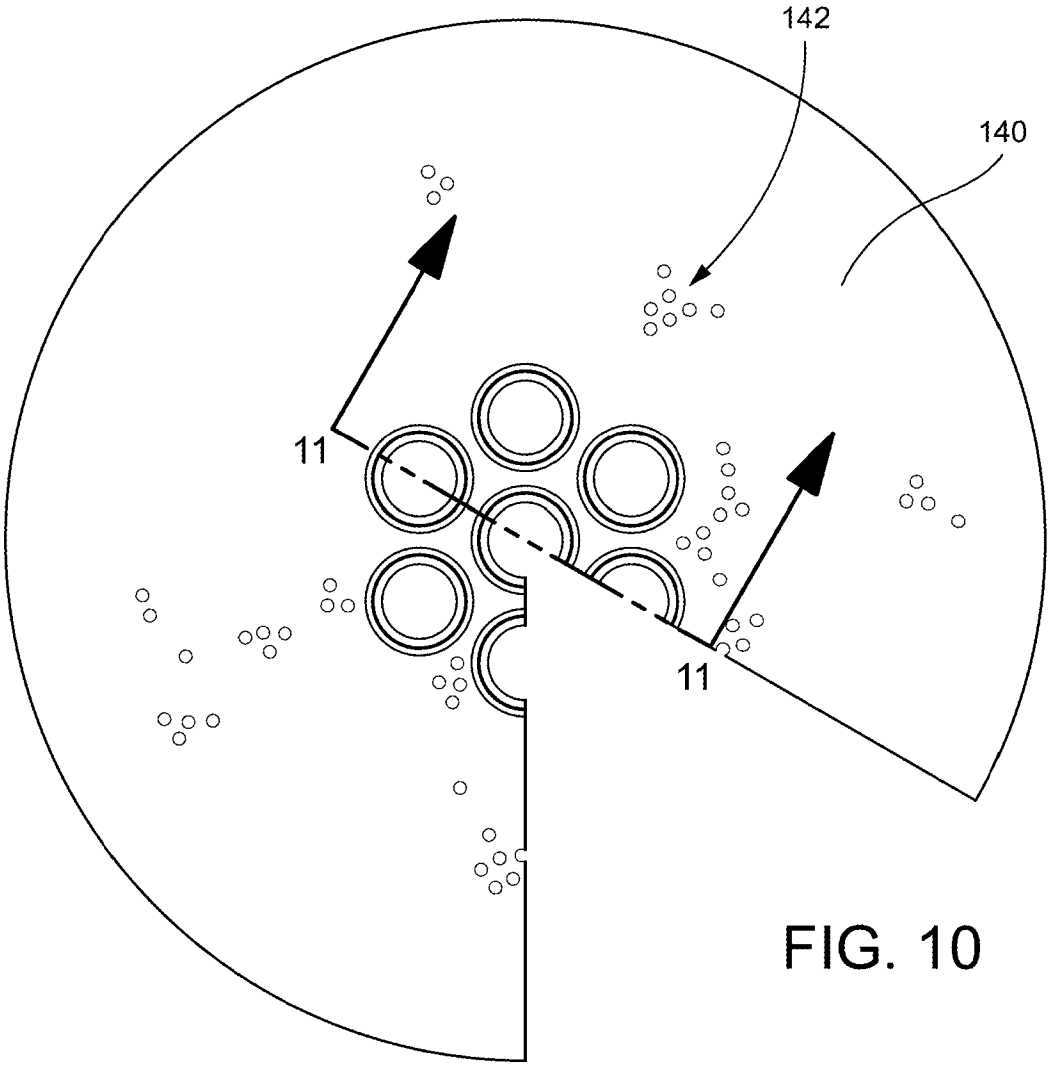
FIG. 10 is a top view of the distribution plate assembly of FIG. 9.
Figure 11:
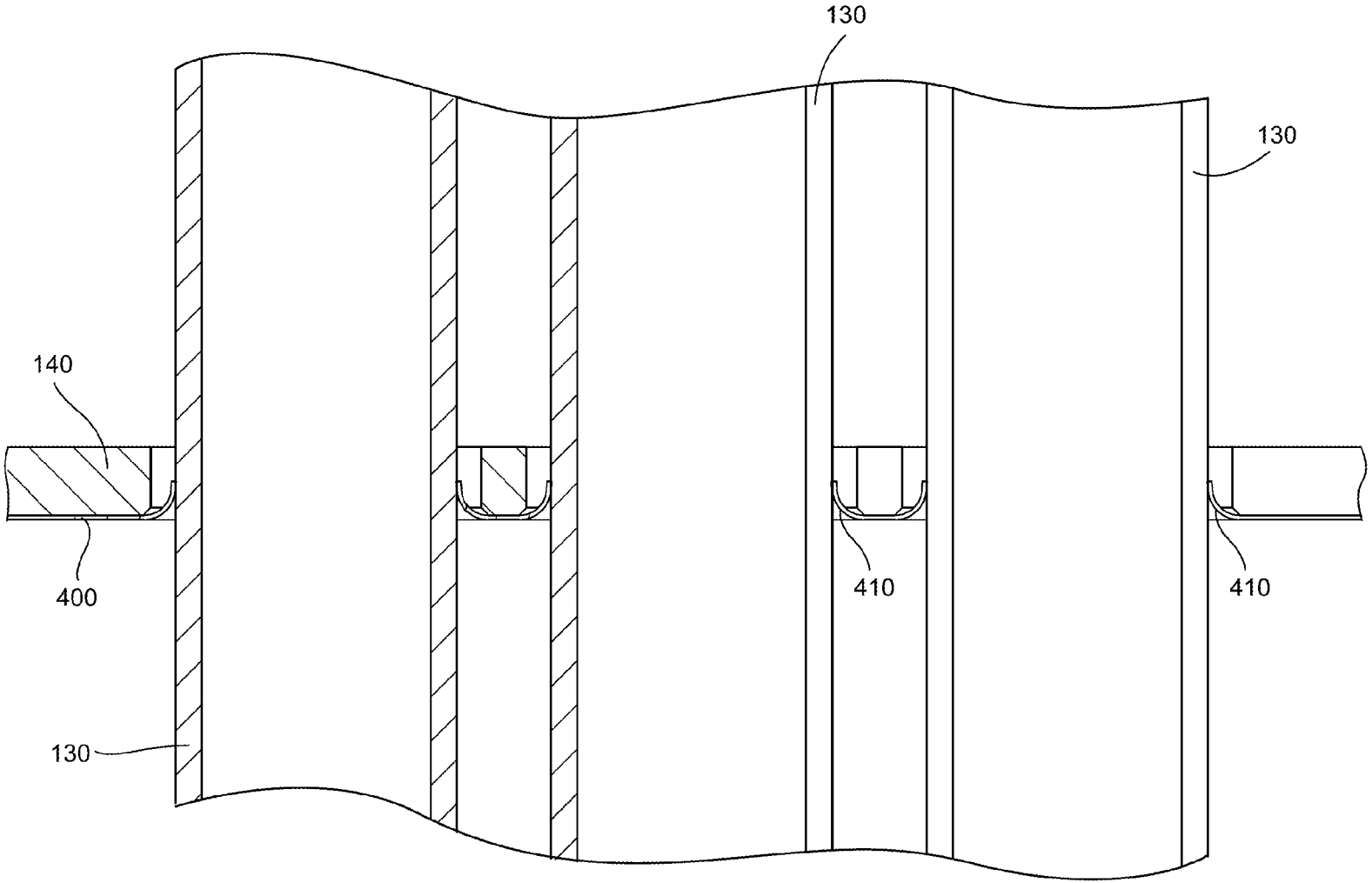
FIG. 11 is a cross-sectional view along the line 11-11 of FIG. 10.
Figure 12:
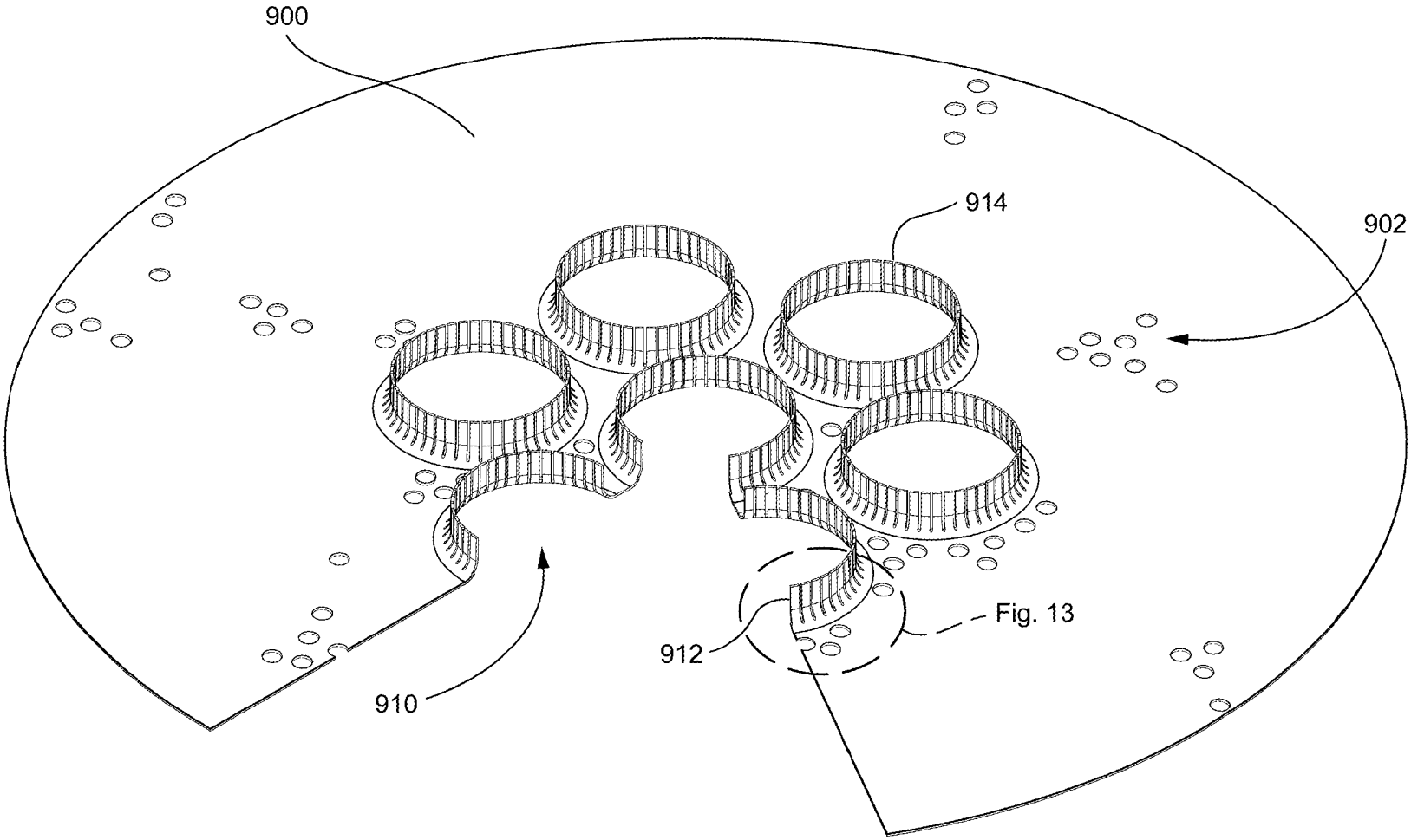
FIG. 12 is a perspective view of a metering plate according to a second example of the disclosed technology.

The distribution plate 140 includes a plurality of tube holes 144 for accommodating the mixing tubes 130 and a plurality of distribution holes 142 for passing the fuel flow 110 through the distribution plate 140, as best shown in FIGS. 5 and 6. It is noted that the distribution plate 140 may only have the tube holes 144 for passing the fuel flow, as the distribution holes 142 are optional. The tube holes 144 are formed large enough such that the mixing tubes 130 do not contact the distribution plate 140. This arrangement minimizes wear to the distribution plate and the mixing tubes and further avoids damage that may be caused by sudden movement of the distribution plate or mixing tubes. Only one distribution hole 142 is shown in the schematic illustration of FIG. 4; however, the distribution holes may be interspersed in the distribution plate 140 among the tube holes 144, as shown in FIG. 6.

The tube holes 144 and the mixing tubes 130 form annulus areas 146 between the distribution plate 140 and the mixing tubes. As the size of the annulus areas increases, however, uniform distribution of the fuel flow 110 to the fuel holes 132 is reduced due to poor fuel flow distribution through the distribution plate 140 as a consequence of increased flow passing through the annulus areas 146.

In FIG. 6, it is seen that the distribution holes 142 are interspersed in the distribution plate 140 among the tube holes 144. It is noted that the distribution holes 142 may be arranged in the distribution plate in any suitable manner. For illustration purposes, the tube holes 144 (and mixing tubes 130) are only shown in a central portion of the distribution plate; however, the tube holes may occupy a smaller or larger portion of the distribution plate and further may be arranged in any suitable manner on the distribution plate. Preferably, the distribution holes 142 are arranged to promote uniform distribution of the fuel flow 110 through the distribution holes 142.

It is typically desired to place an equal amount of fuel into each mixing tube 130 (assuming an equal amount of air is also provided). Providing a uniform fuel/air composition to each of the mixing tubes 130 has been found to minimize nitrogen oxides. One source of fuel non-uniformity involves some mixing tubes 130 being preferentially fed due to their proximity to the fuel supply (e.g., fuel inlet 62).

The gap between the distribution plate 140 and the mixing tubes 130 is desirably small (e.g., 0.003 in) in order to achieve a desired pressure drop on the downstream side (with respect to the fuel flow 110) of the distribution plate 140. Such pressure drop may cause the fuel flow 110 to utilize all passages in the distribution plate 140 and therefore encourage a more uniform flow to the fuel holes 132.

In an example, the target diameter of the mixing tubes 130 may be 0.370 inches and the target diameter of the tube holes 144 may be 0.373 inches, thus resulting in an annulus area of 0.00175 $in^2$. However, a tube hole oversized or undersized by only 0.001 inches will result in a +/−33% size variation in the annulus area 146 leading to wide variations in fuel flow through the distribution plate.

Eliminating the annulus areas 146 all together in favor of only the distribution holes 142 is not desirable since brazing or welding the mixing tubes 130 to the distribution plate 140 creates thermally induced stresses as the mixing tubes 130 move relative to their housing. Such process of brazing or welding is also relatively expensive.

The embodiments of the disclosed technology describe sealing devices which create a known and repeatable effective size of the annulus areas 146 thereby eliminating variability of size of the annulus areas and permitting uniform fuel flow across the distribution plate 140.

Turning to FIGS. 7-11, a sealing plate 400 for controlling fuel flow through the annulus areas 146 is shown in accordance with an example of the disclosed technology. The sealing plate is formed of a thin metal sheet and is attached to an upstream side of the distribution plate 140. It is noted, however, that one skilled in the art will understand that the sealing plate may be configured for attachment to a downstream side of the distribution plate. The sealing plate 400 includes a plurality of sealing elements 410 formed as holes in the sealing plate corresponding to at least a portion of the tube holes 144 and sized to contact the mixing tubes 130 within the annulus areas 146. The sealing plate also includes features, such as a plurality of through holes 402 which allow the fuel flow 110 to pass through the distribution holes 142.

The sealing plate 400 may be integrally attached to the distribution plate 140 or tubes 130 by welding or brazing. The sealing plate 400 may also be attached mechanically with bolted fasteners or rivets. However, the sealing plate can be constrained by the pressure loading across the plate and the compression force of the sealing elements 410 (or fingers described below) against the tube walls.

The sealing elements 410 affect the fuel flow 110 passing through the annulus areas 146 (see FIGS. 4 and 5 along with FIG. 9) while also dampening vibration of the mixing tubes. The sealing elements 410 are configured to seal against the mixing tubes 130 to prevent the fuel flow 110 from passing through the annulus areas 146. The sealing elements include an angled portion 412 extending at an incline to the sealing plate and an engaging portion 414 connected to the angled portion. The engaging portion 414 extends at an incline to the angled portion 412 and engages the mixing tubes 130 to form a seal. The respective sizes and orientations of the angled portion 412 and the engaging portion 414 may be modified to adjust the seal with the mixing tubes. By sealing the annulus areas 146 and restoring total (or near total) flow of the fuel flow 110 to the distribution holes 142, a more even distribution of the fuel flow through the distribution plate 140 may be achieved. A more uniform flow through the distribution plate may more evenly distribute the fuel flow to the fuel holes 132. It will be appreciated that a negligible level of leakage may be observed at the annulus areas 146. Furthermore, the sealing elements 410 may actually be configured to provide a desired level of leakage.

As discussed above, the sealing elements 410 contact the mixing tubes 130. The sealing elements 410 (and the fingers and thimbles described below) may be made of spring steel or other suitable materials, such as Standard 300/400 series stainless steels and nickel alloys. This arrangement effectively causes the sealing elements 410 to dampen vibration of the mixing tubes 130. The sizes and orientations of the angled portion 412 and the engaging portion 414 can also be adjusted to increase or decrease the contact area with the mixing tubes 130 to adjust the level of dampening. The sealing elements are also compliant so as to accommodate for movement and misalignment of the mixing tubes 130.

Instead of sealing the annulus areas 146, a sealing plate may be configured to meter the fuel flow through the annulus areas, thereby distributing the fuel flow 110 between the distribution holes 142 and the annulus areas 146 as desired. Referring to FIGS. 12-16, a metering plate 900 is shown in accordance with another example of the disclosed technology. The metering plate includes features such as a plurality of through holes 902 corresponding to the distribution holes 142 of the distribution plate 140. In contrast to the sealing plate 400 described above, the metering plate 900 includes a plurality of metering elements 910 comprised of fingers 912 separated by spaces 914. The respective sizes of the fingers 912 and spaces 914 can be adjusted to achieve a desired level of metering, stiffness, and/or contact area with the mixing tubes 130.

Figure 13:
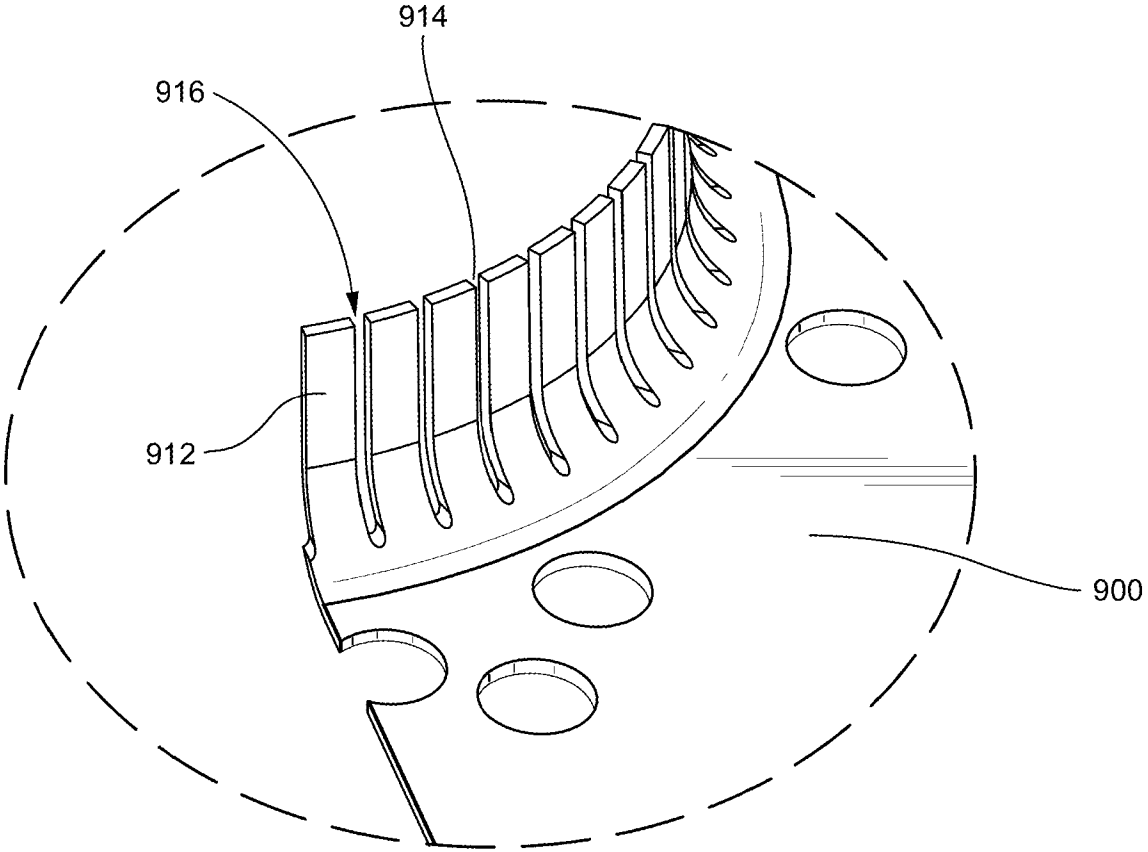
FIG. 13 is an enlarged detail taken from FIG. 12.
Figure 14:
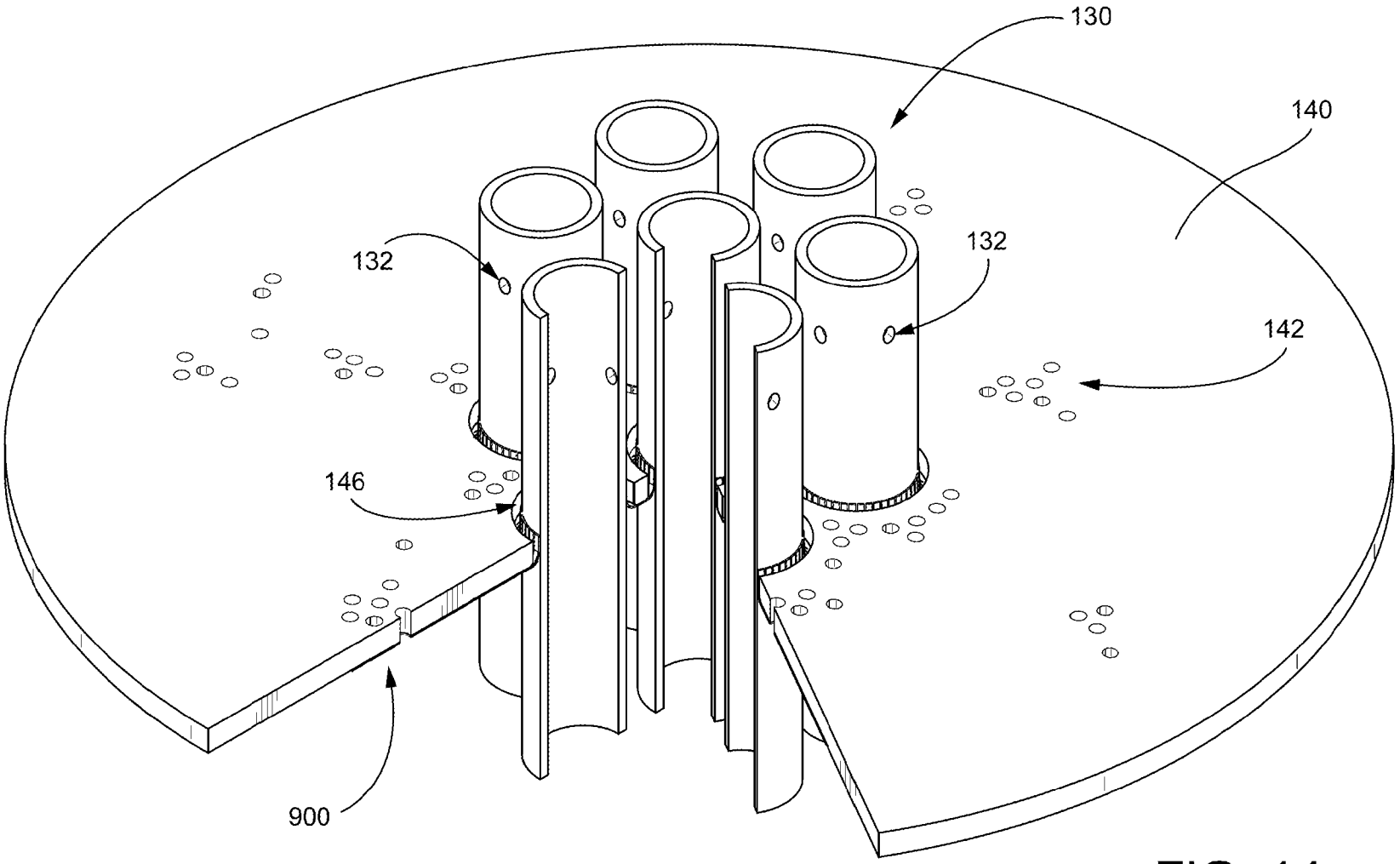
FIG. 14 is a perspective view of a distribution plate assembly including the metering plate of FIGS. 12 and 13.
Figure 15:
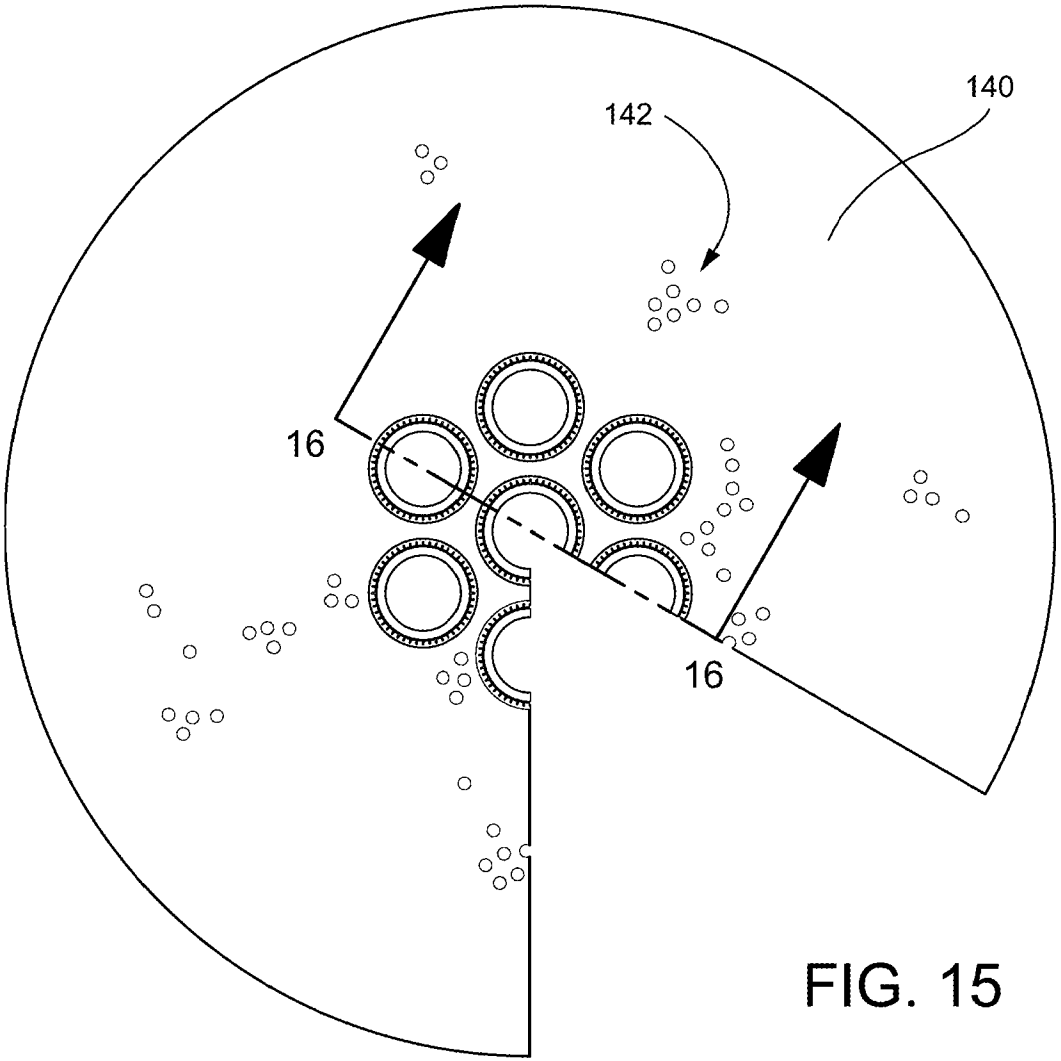
FIG. 15 is a top view of the distribution plate assembly of FIG. 14.
Figure 16:
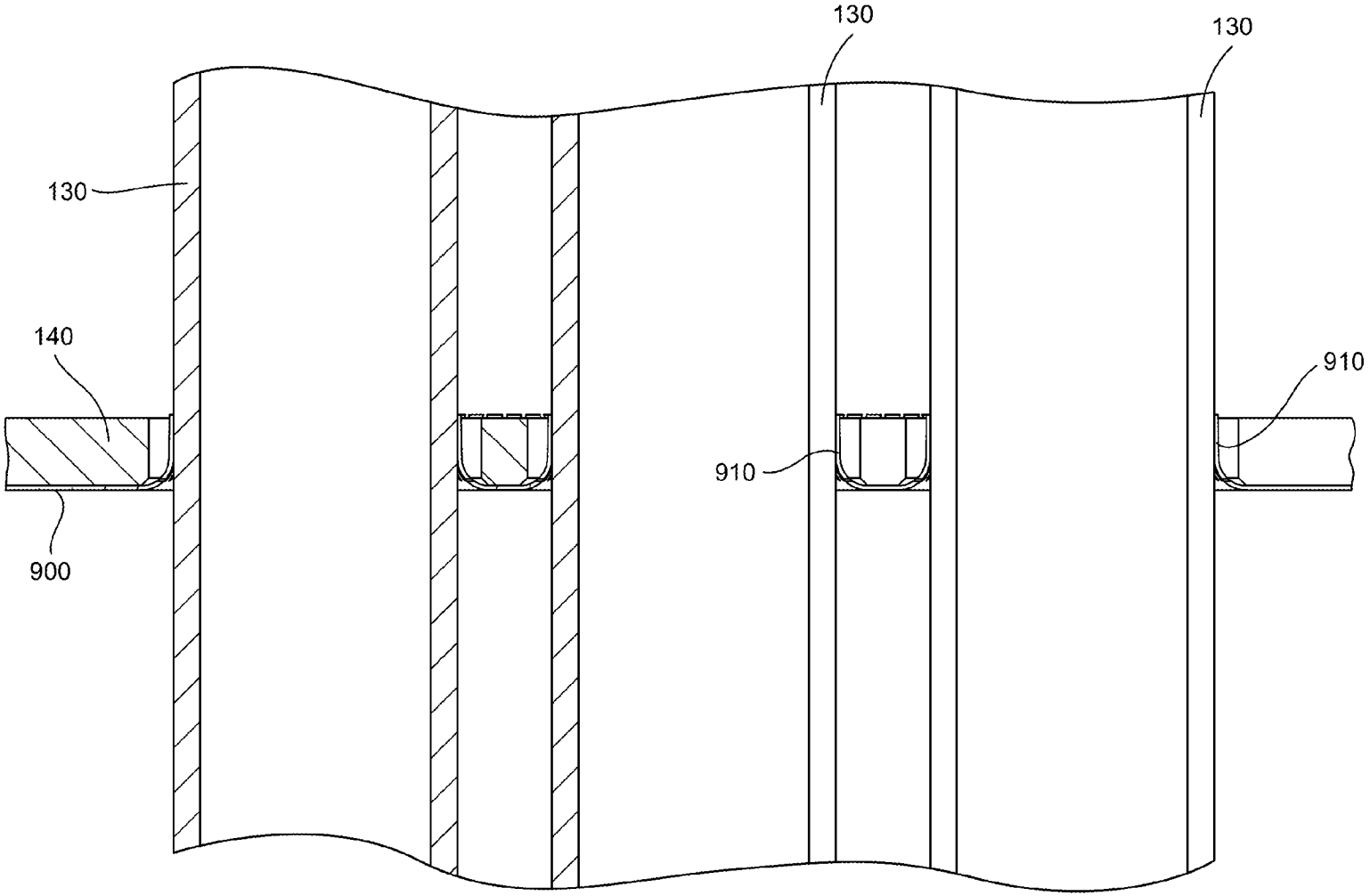
FIG. 16 is a cross-sectional view along the line 16-16 of FIG. 15.
Figure 17:
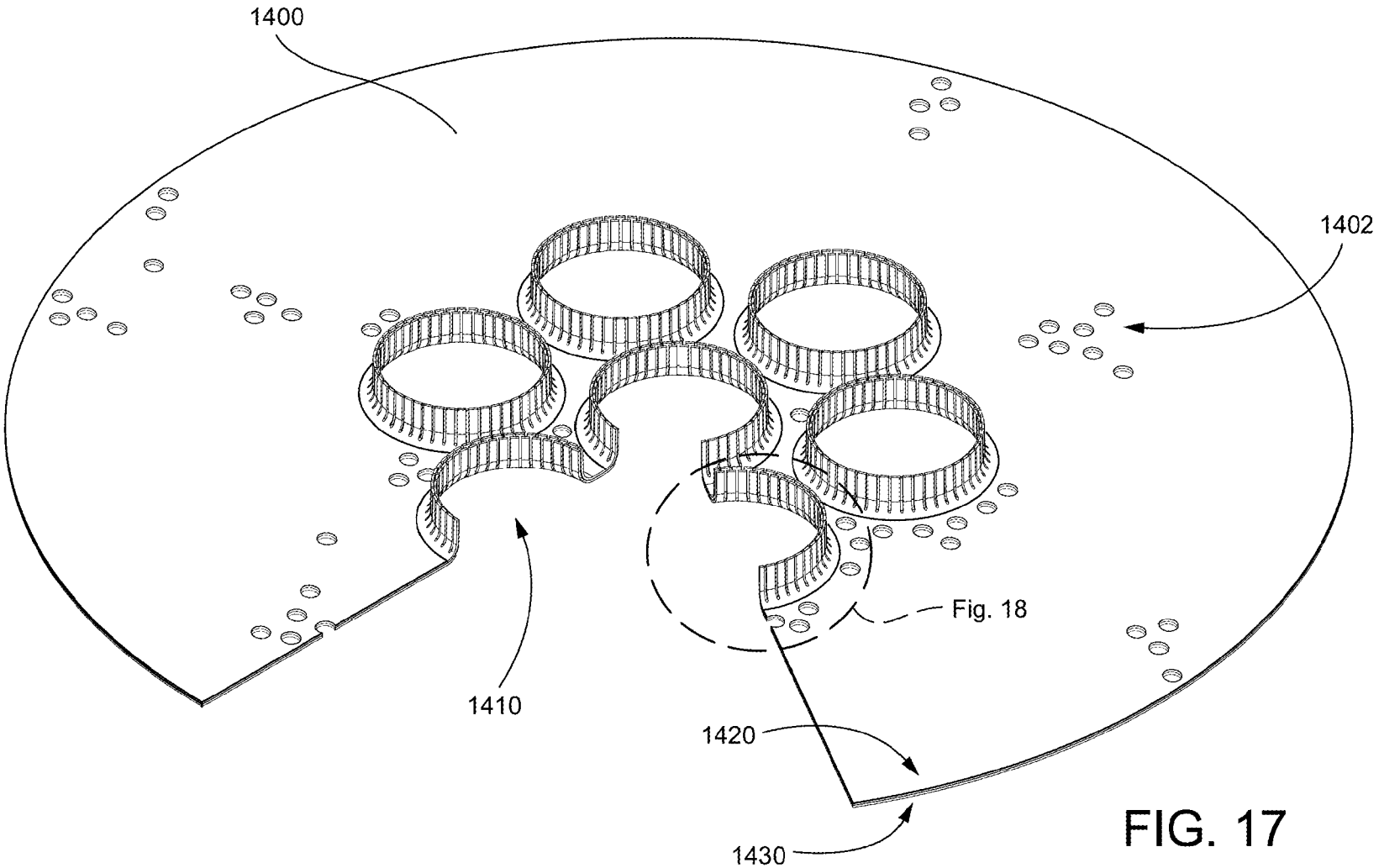
FIG. 17 is a perspective view of a two-ply metering plate according to a third example of the disclosed technology.
Figure 18:
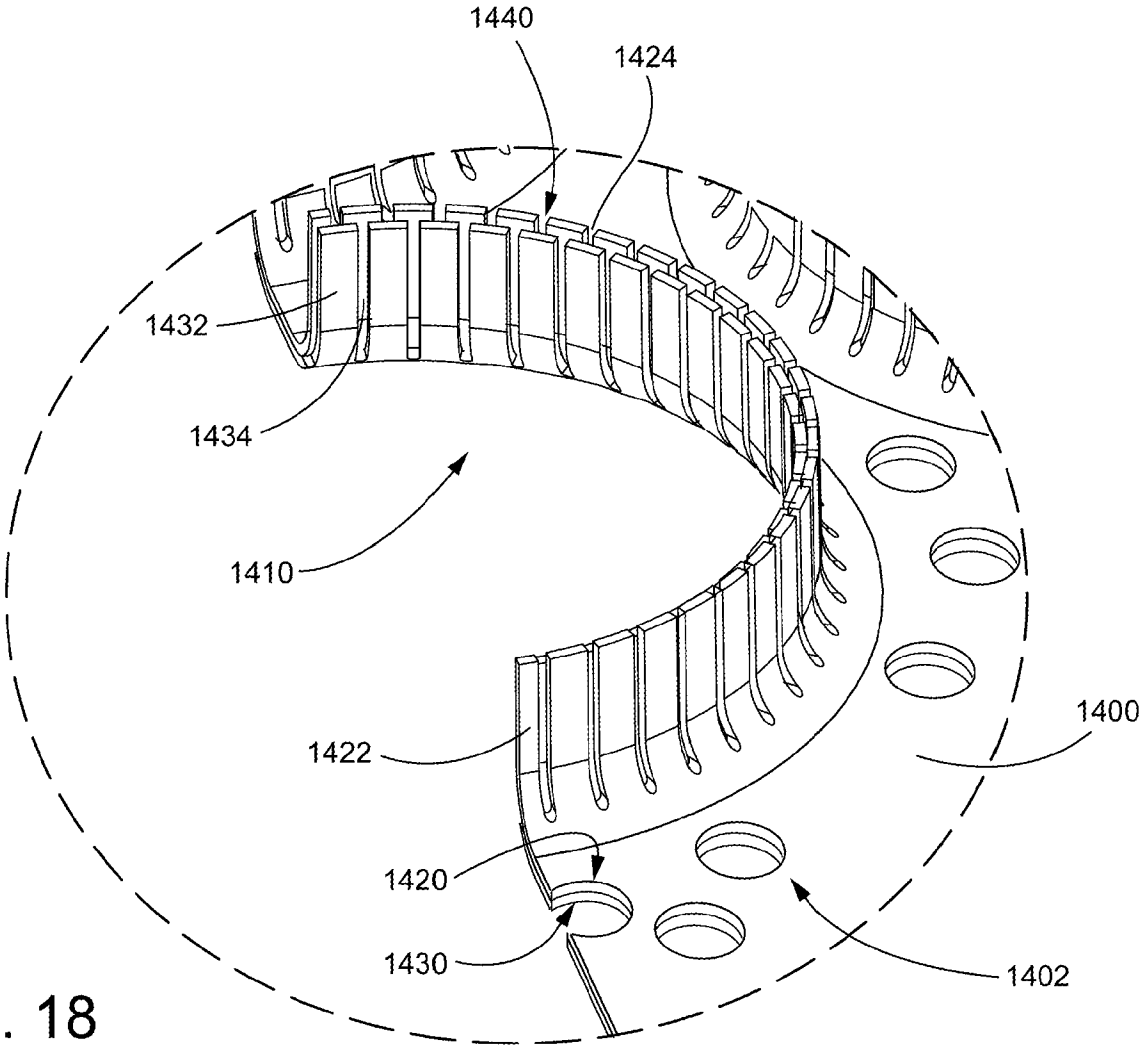
FIG. 18 is an enlarged detail taken from FIG. 17.
Figure 19:
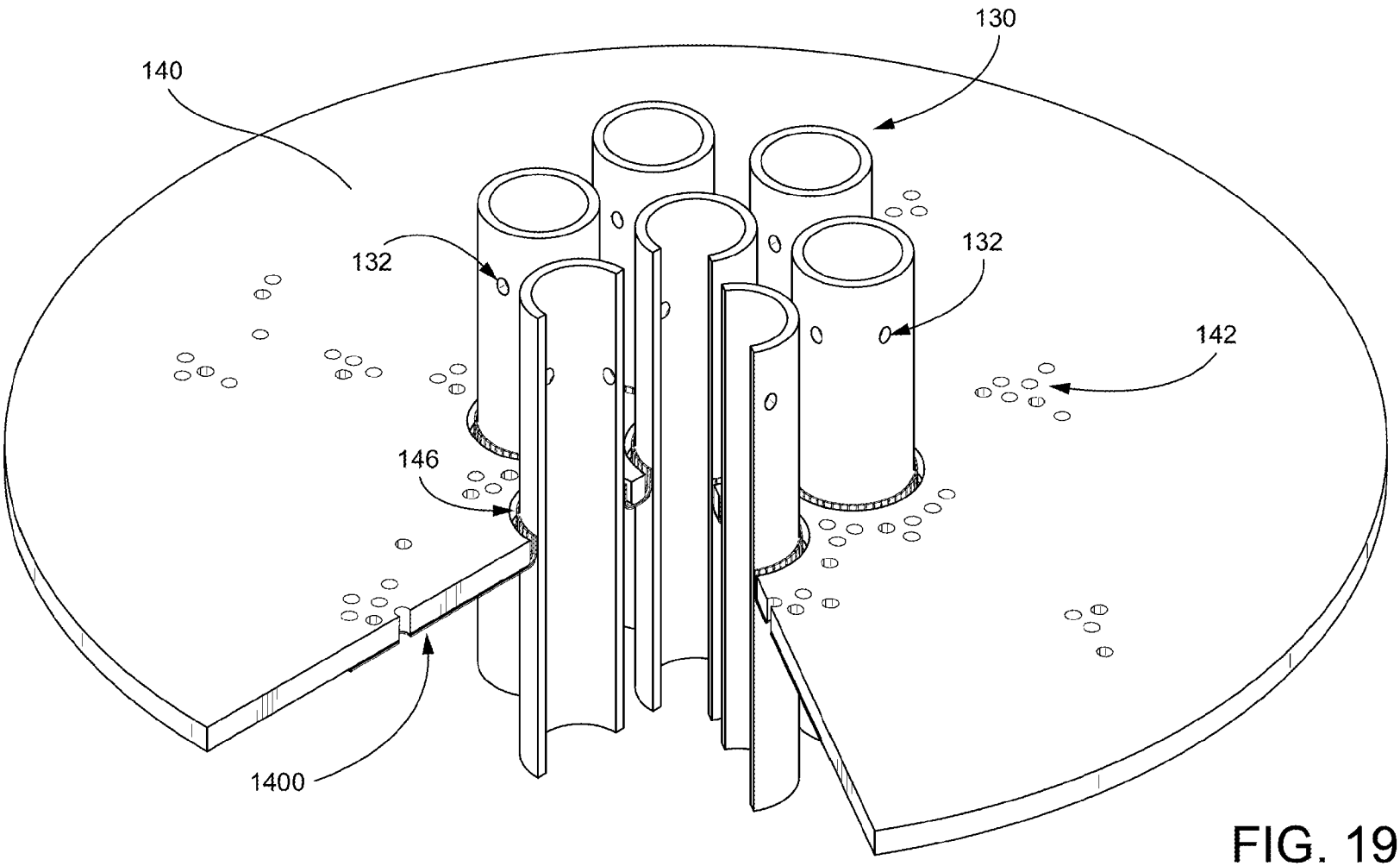
FIG. 19 is a perspective view of a distribution plate assembly including the two-ply metering plate of FIGS. 17 and 18.
Figure 20:
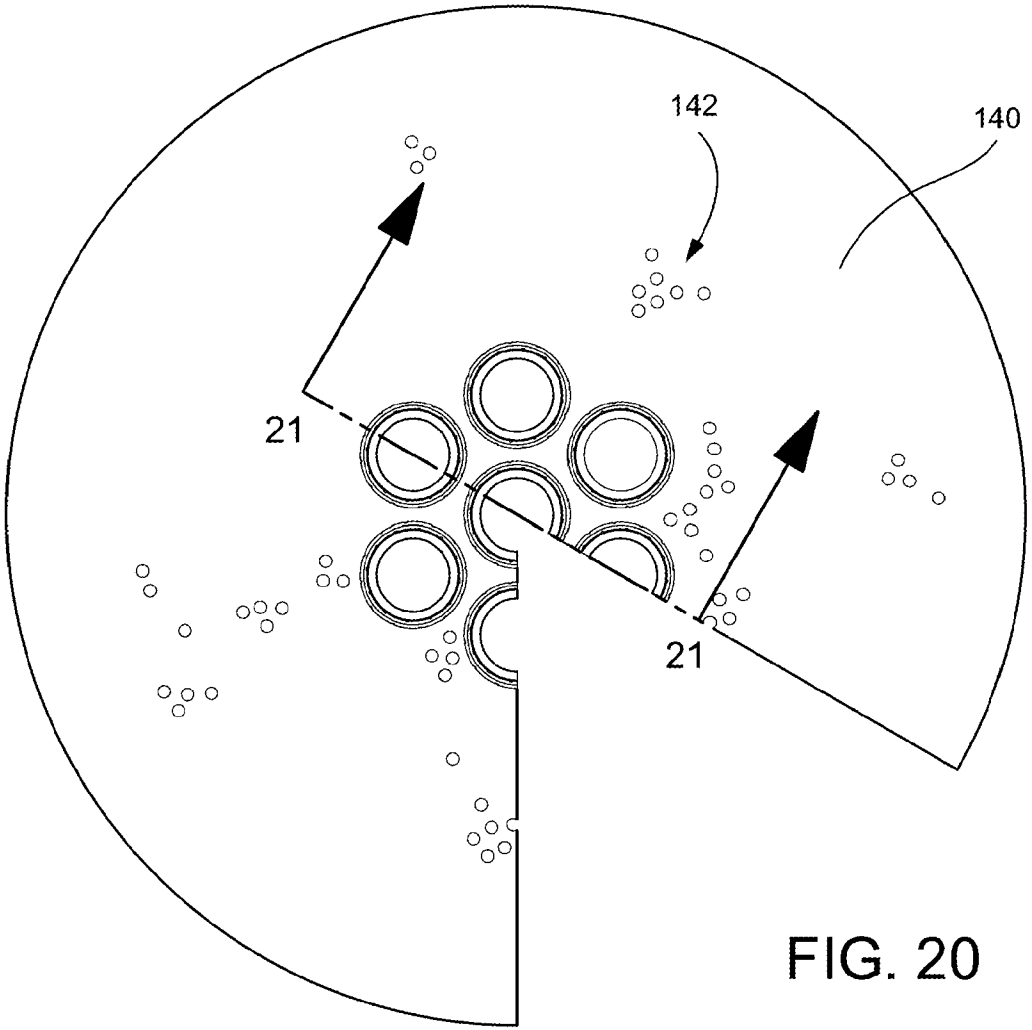
FIG. 20 is a top view of the distribution plate assembly of FIG. 19.
Figure 21:
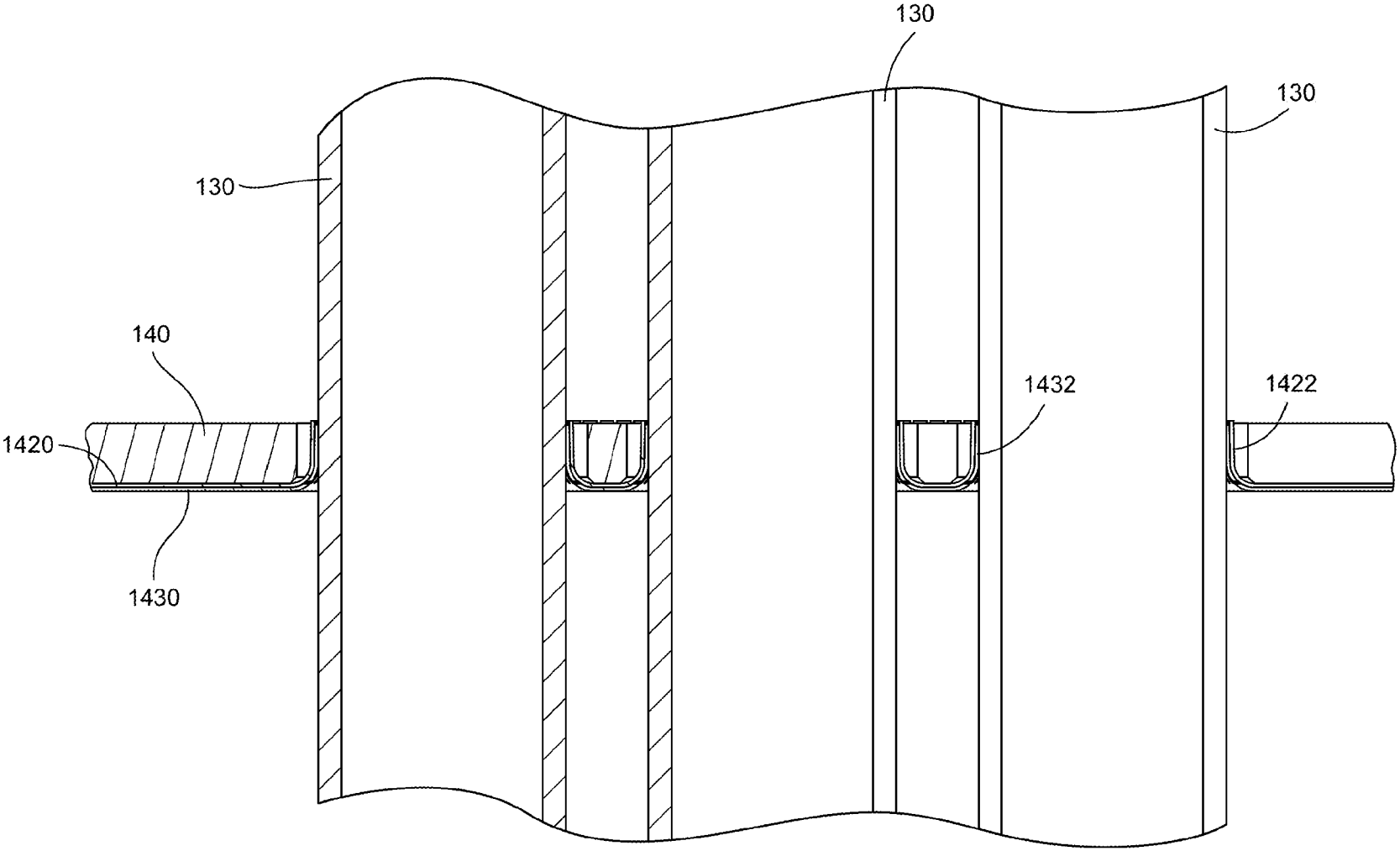
FIG. 21 is a cross-sectional view along the line 21-21 of FIG. 20.
Figure 22:
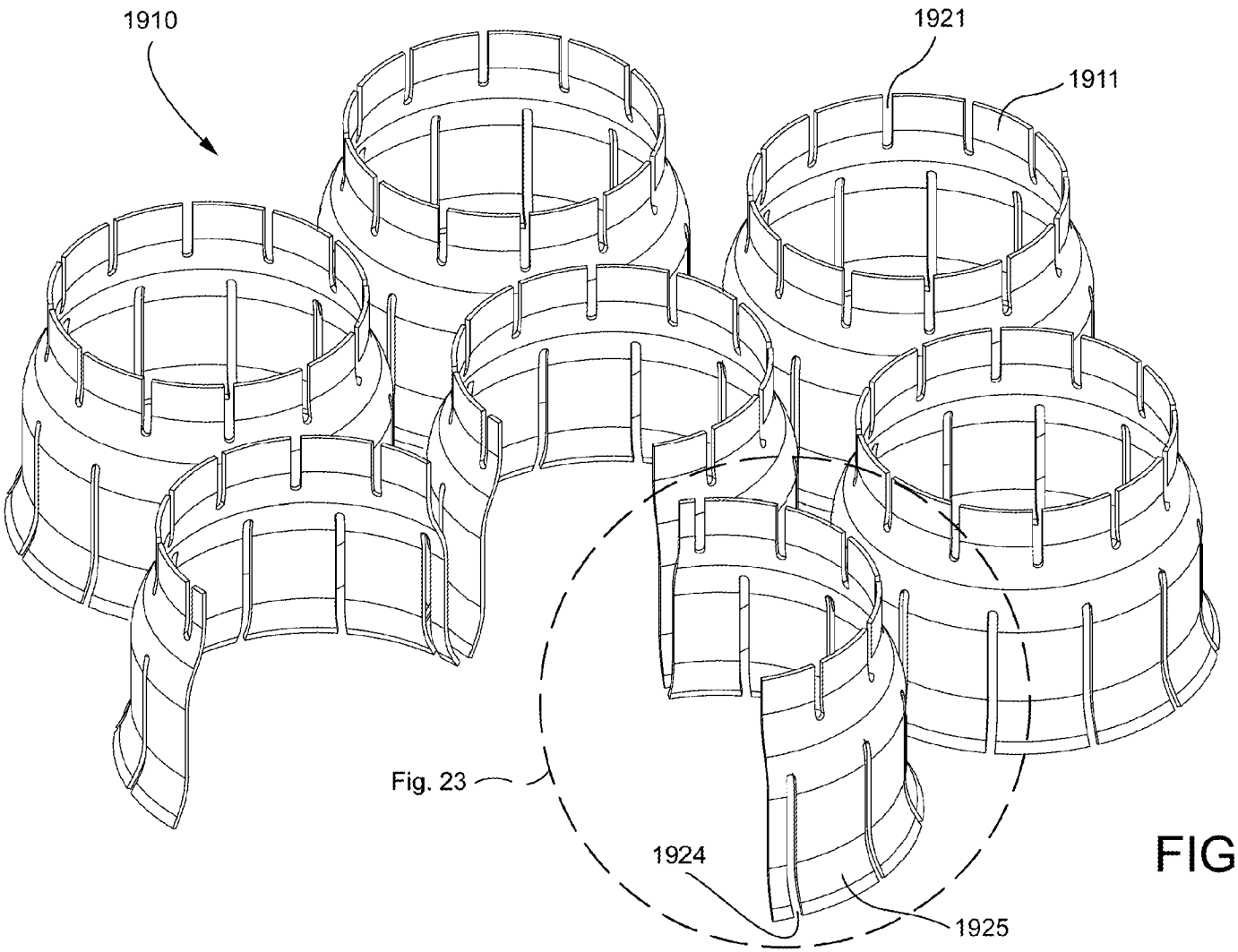
FIG. 22 is a perspective view of individual metering thimbles according to a fourth example of the disclosed technology.
Figure 23:
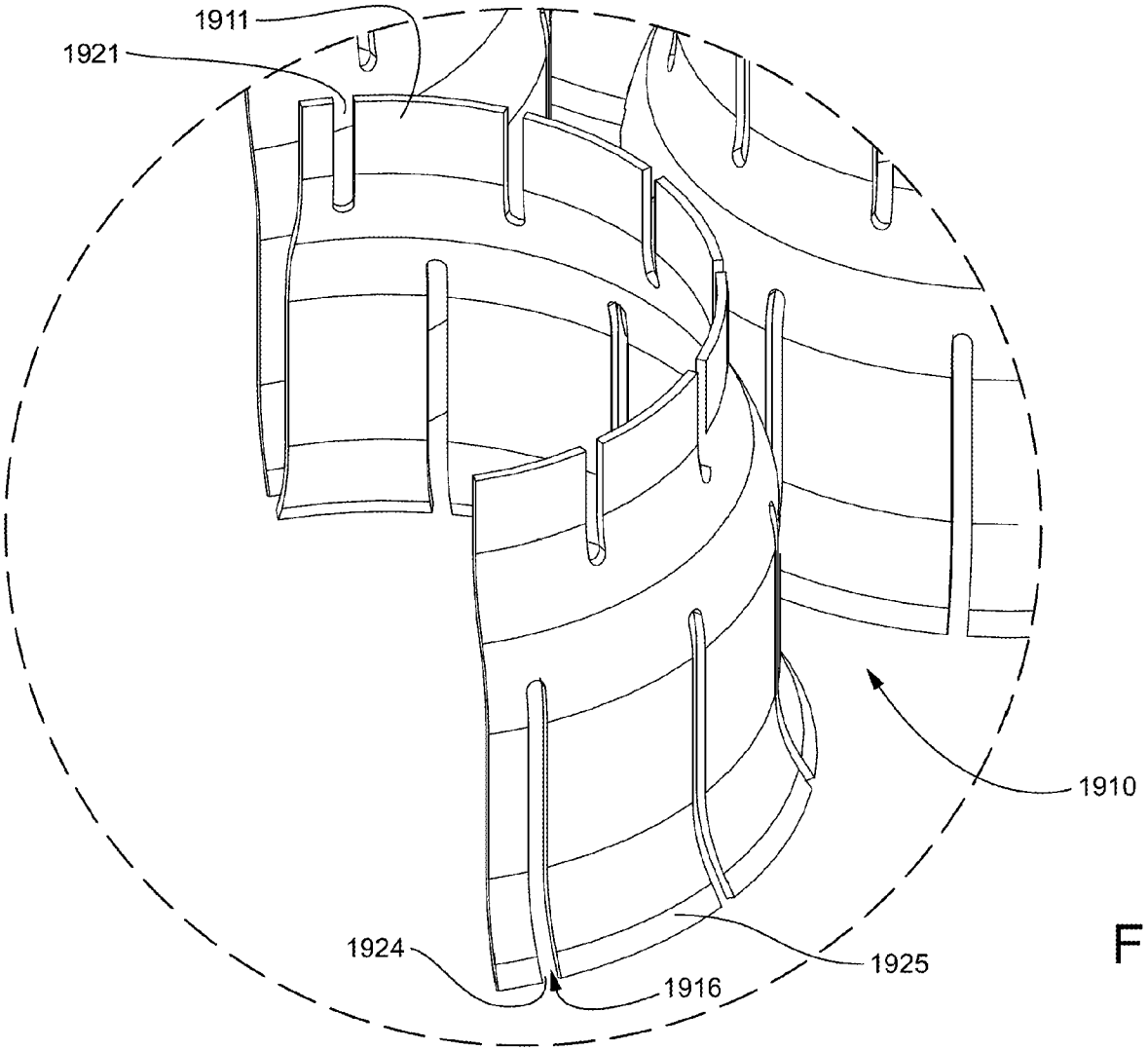
FIG. 23 is an enlarged detail taken from FIG. 22.
Figure 24:
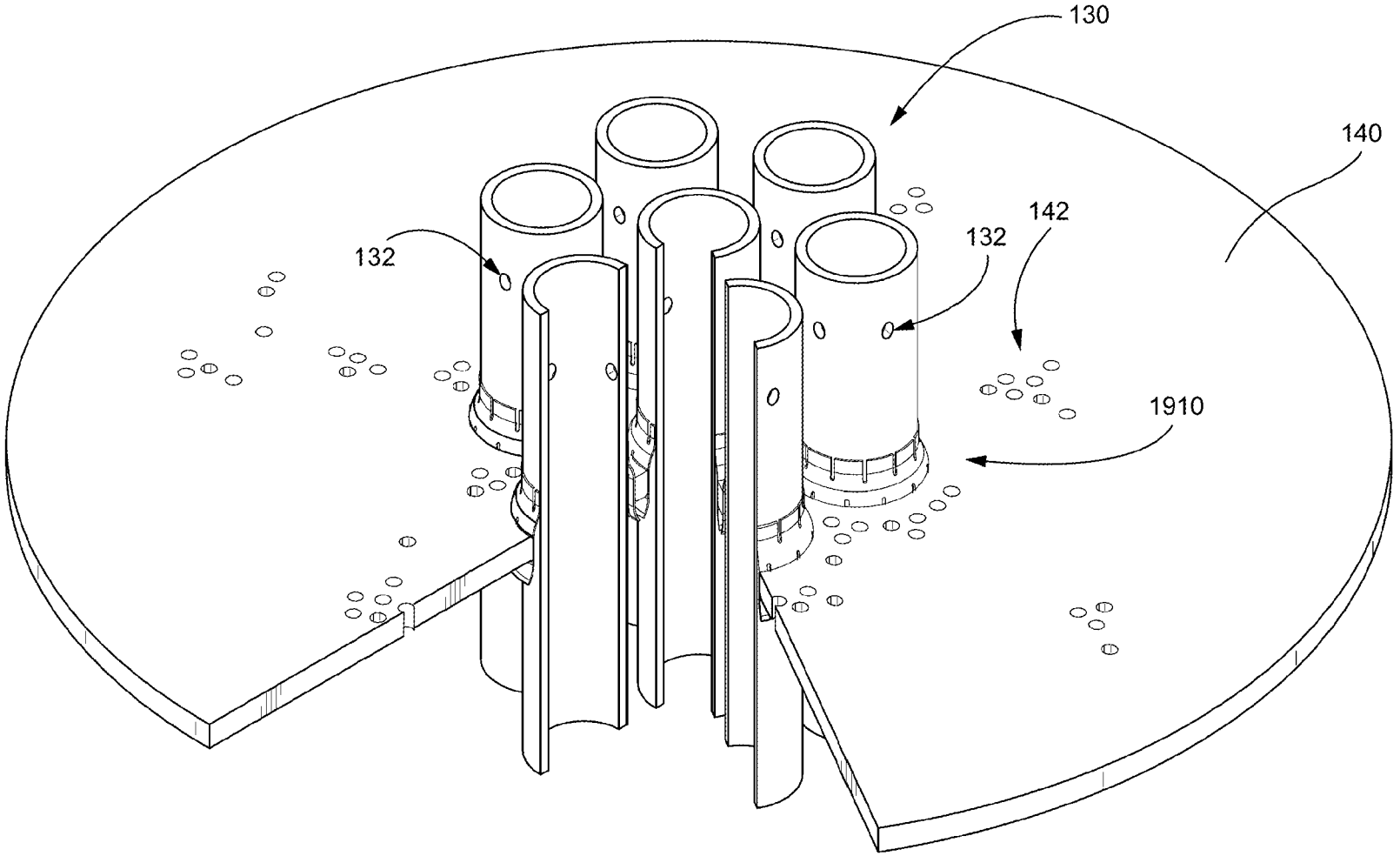
FIG. 24 is a perspective view of a distribution plate assembly including the thimbles of FIGS. 22 and 23.
Figure 25:
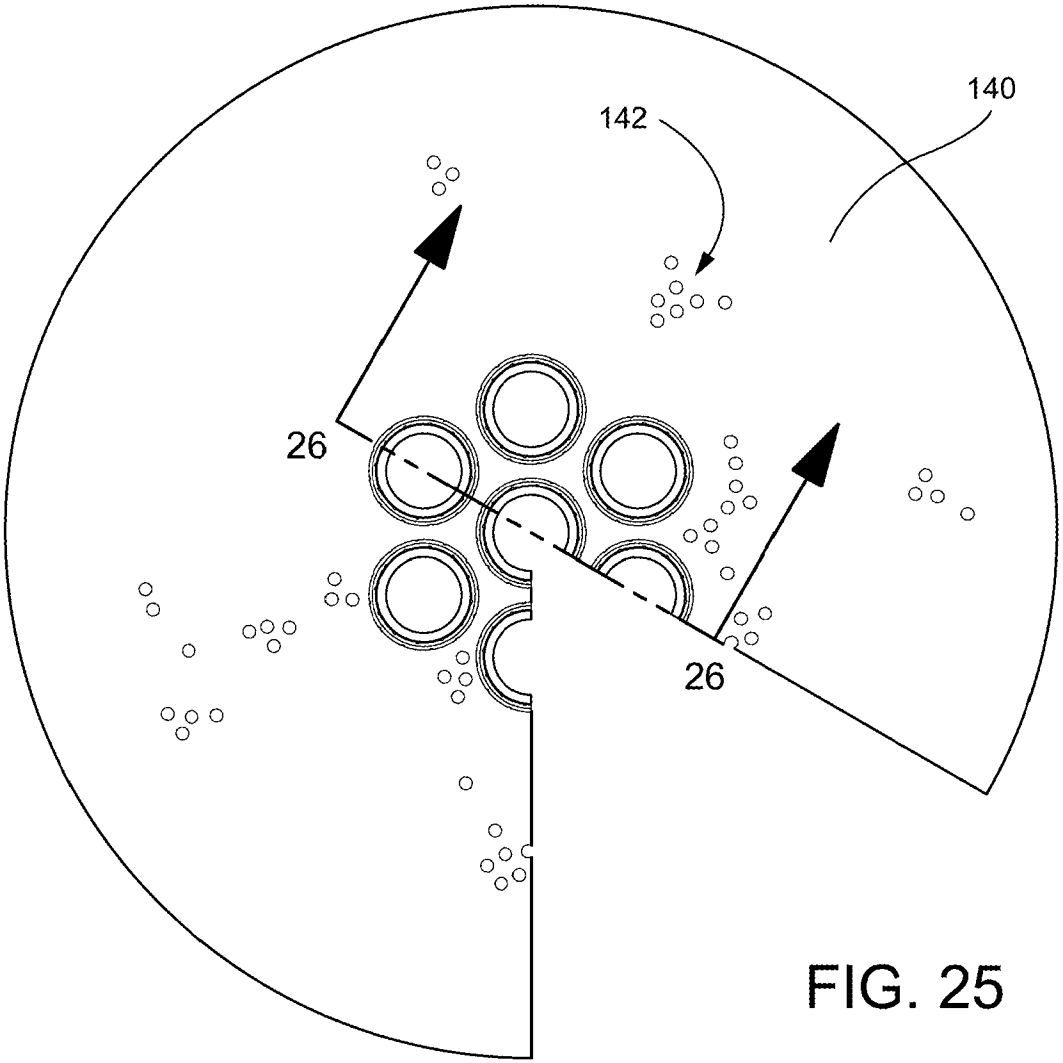
FIG. 25 is a top view of the distribution plate assembly of FIG. 24.
Figure 26:
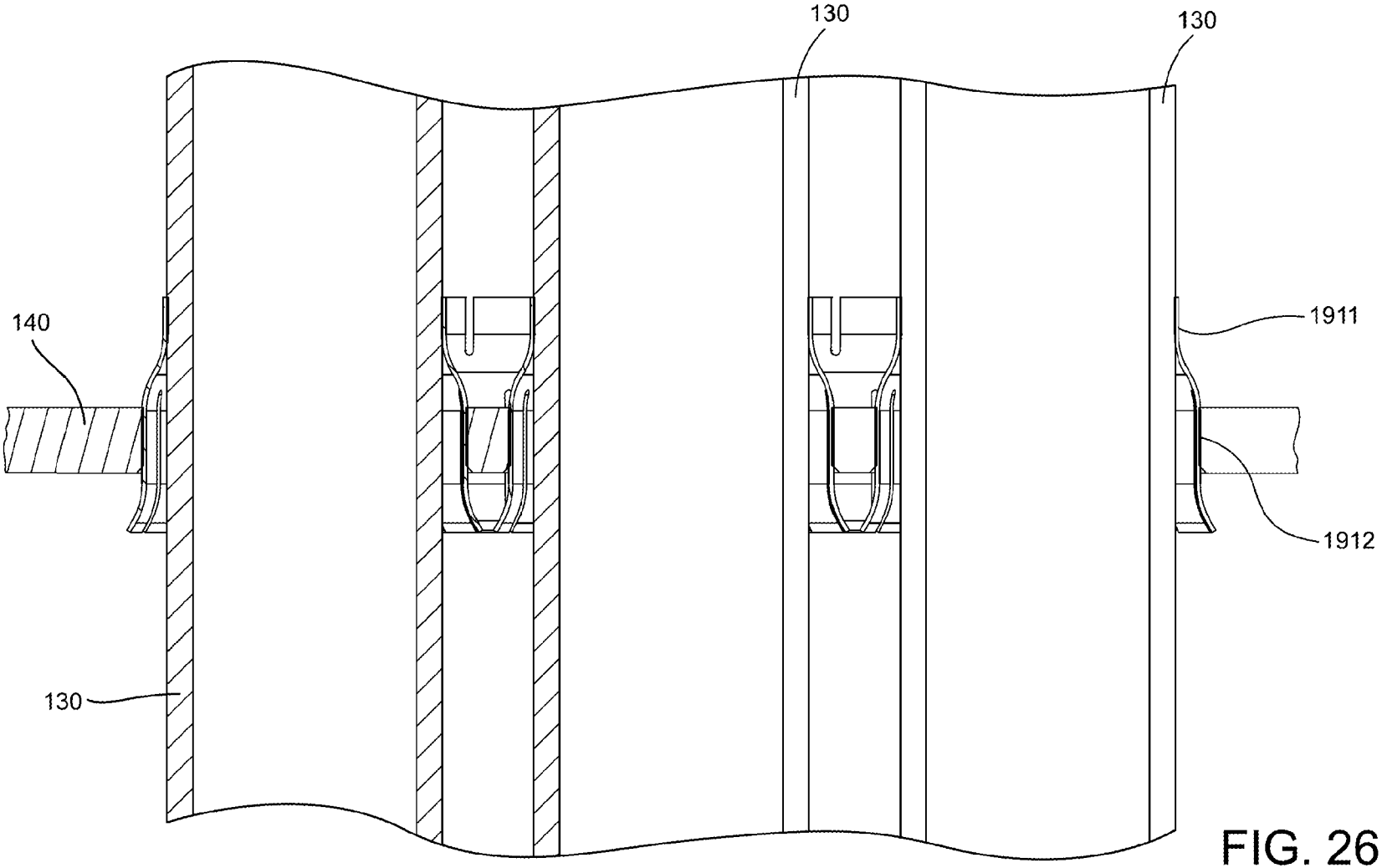
FIG. 26 is a cross-sectional view along the line 26-26 of FIG. 25.

The fingers 912 effectively reduce the size of the annulus areas such that the spaces 914 form a plurality of channels 916 through which the fuel flow 110 is allowed to pass through the annulus areas 146, as shown in FIG. 13. As a width of the fingers 912 increases, the channels 916 become smaller which causes a larger portion of the fuel flow 110 to be distributed to the distribution holes 142. The distribution of the fuel flow 110 between the distribution holes 142 and the annulus areas 146 may be fine tuned to achieve a uniform fuel flow across the distribution plate 140. The fingers 912 are also flexible which enables dampening of vibrations and accommodation of movement and misalignment of the mixing tubes 130. The respective sizes of the fingers 912 and the spaces 914 may also be adjusted to affect the stiffness of the fingers 912 to achieve a desired level of dampening and/or support.

Turning to FIGS. 17-21, a two-ply metering plate 1400 is shown in accordance with another example of the disclosed technology. The two-ply metering plate 1400 includes a plurality of through holes 1402 corresponding to the distribution holes 142 of the distribution plate 140. In contrast to the metering plate 900 described above, the two-ply metering plate 1400 includes a top metering plate 1420 and a bottom metering plate 1430 attached to the top metering plate. The top metering plate 1420 has a plurality of first fingers 1422 separated by first spaces 1424, while the bottom metering plate 1430 has a plurality of second fingers 1432 separated by second spaces 1434. The first fingers 1422, first spaces 1424, second fingers 1432, and second spaces 1434 effectively form a series of metering elements 1410.

The first spaces 1424 and the second spaces 1434 together form a plurality of channels 1440 through which the fuel flow 110 is allowed to pass through the annulus areas 146. The first and second spaces 1424, 1434 may be aligned or offset as desired to affect distribution of the fuel flow 110 between the distribution holes 142 and the annulus areas 146.

The two-ply nature of the first and second fingers 1422, 1432 may combine to provide a stiffer component (first and second fingers together) which may aid in achieving a desired level of dampening and/or support. Additionally, the first and second fingers 1422, 1432 may be aligned or offset as desired to affect stiffness.

In FIGS. 22-26, a plurality of thimbles 1910 is shown in accordance with another example of the disclosed technology. The thimbles may be individually attached to and removed from the mixing tubes 130. Accordingly, a damaged thimble may be individually removed and replaced which may reduce repair costs.

The thimbles include a plurality of fingers 1925 separated by spaces 1924. The spaces 1924 form a plurality of channels 1916, shown in FIG. 23, which allow the fuel flow 110 to pass through the annulus areas 146. The size of the fingers 1925 and the spaces 1924 may be adjusted to affect metering and dampening in the same manner as the fingers and spaces described above in the previous embodiments.

A plate engaging section 1912 extends circumferentially around a middle portion of the thimbles 1910 for engaging the distribution plate 140. The plate engaging section 1912 may be snap fit, interference fit, or otherwise attached to the distribution plate 140. In addition to providing channels 1916 for conveying the fuel flow 110, the spaces 1924 may also allow the plate engaging section 1912 to flex to accommodate the distribution plate 140. The mixing tubes 130 may then be inserted into the thimbles 1910. The thimbles further include a plurality of tube engaging portions 1911 separated by slits 1921. The tube engaging portions 1911 are configured to receive the mixing tubes 130 by interference fit. The slits 1921 may allow the tube engaging portions 1911 to flex so as to accommodate misalignment of the mixing tubes 130.

Alternatively, it is noted that the thimbles 1910 may first be attached to the mixing tubes 130 and then connected to the distribution plate 140.

Figure 27:
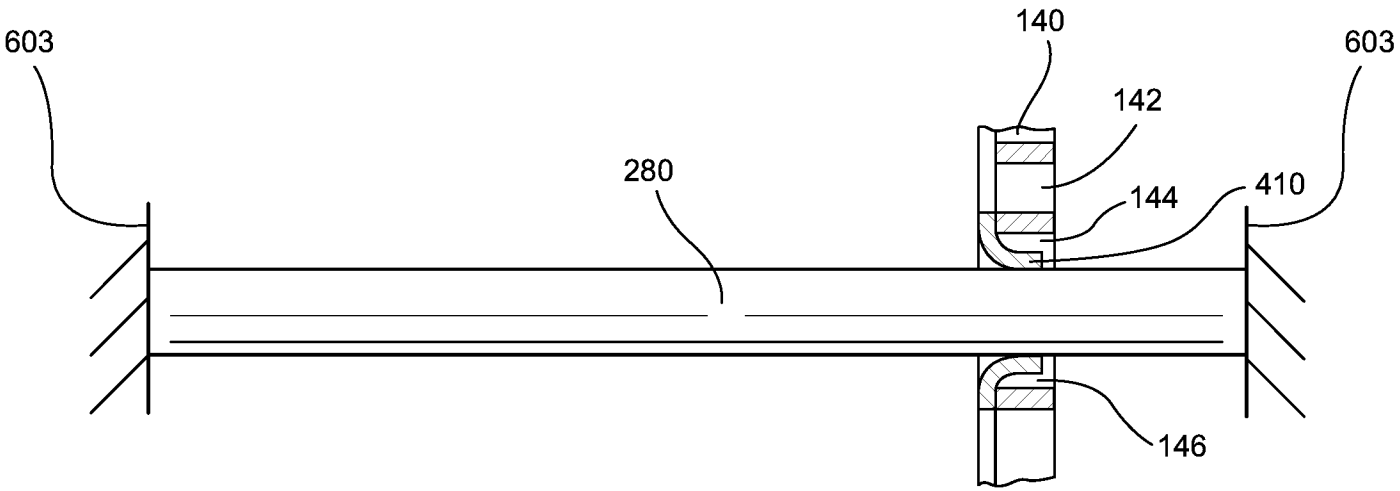
FIG. 27 is a side view of a mixing tube and distribution plate assembly according to a fifth example of the disclosed technology.

FIG. 27 illustrates a simply supported mixing tube 280 attached frame members 603. Frame members 603 may be may outer walls of micromixer 60, for example. Frictional dampening by the sealing elements 410 may reduce fatigue to a mounting joint at the frame members 603. It is noted that the sealing elements 410 are merely shown as an example and that any of the other embodiments described as providing dampening may also be used.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A gas turbine combustor, comprising:

a plurality of mixing tubes arranged to transport a fuel/air mixture to a reaction zone for ignition, each mixing tube including a plurality of fuel holes through which fuel enters the respective mixing tube;

a plate having a plurality of tube holes formed therein, the plurality of tube holes being configured to accommodate the plurality of mixing tubes thereby forming a plurality of annulus areas between the plate and the plurality of mixing tubes, the plurality of annulus areas being configured such that the fuel flows through the plurality of annulus areas, the plurality of fuel holes being arranged on a downstream side of the plate with respect to the fuel flow; and a flow management device directly attached to the plurality of mixing tubes and including a portion situated within the plurality of annulus areas to control a distribution of the fuel to the plurality of fuel holes.

2. The gas turbine combustor of claim 1, wherein the flow management device includes a plurality of metering elements for controlling a flow rate of the fuel flow through the plurality of annulus areas.

3. The gas turbine combustor of claim 1, wherein the plate has a plurality of through-holes formed therein, the plurality of through-holes being arranged such that the fuel flow passes through the plurality of through-holes, and wherein the flow management device includes a plurality of metering elements for controlling a distribution of the fuel flow through the plurality of annulus areas and the plurality of through-holes.

4. The gas turbine combustor of claim 3, wherein the plurality of metering elements include a plurality of fingers and a plurality of spaces separating the plurality of fingers, the plurality of fingers and the plurality of spaces forming a plurality of channels for conveying the fuel flow.

5. The as turbine combustor of claim 4, wherein the size of the plurality of fingers and/or the size of the plurality of spaces controls the distribution of the fuel flow through the plurality of through-holes and the plurality of annulus areas of the plate.

6. The gas turbine combustor of claim 4, wherein the plurality of fingers includes a plurality of overlapping fingers.

7. The gas turbine combustor of claim 4, wherein the plurality of metering elements includes a plurality of discrete thimbles.

8. The gas turbine combustor of claim 4, wherein the plate is a fuel distribution plate and the plurality of through-holes are distribution holes.

9. A method of controlling fuel flow through a plate in a gas turbine, the plate including a plurality of tube holes formed therein, the tube holes being adapted to accommodate a plurality of mixing tubes with which the tube holes form a plurality of annulus areas, the plurality of mixing tubes being arranged to transport a fuel/air mixture to a reaction zone for ignition, the method comprising:

establishing a fuel flow adapted to pass through the annulus areas;

adjusting an effective size of the plurality of annulus areas to control a flow rate of the fuel flow through the plurality of annulus areas of the plate with a flow management device directly attached to the plurality of mixing tubes; and mixing the fuel flow with air in the plurality of mixing tubes to form the fuel/air mixture.

10. The method of claim 9, wherein each mixing tube includes a plurality of fuel holes through which fuel enters the respective mixing tube, the plurality of fuel holes being arranged on a downstream side of the plate with respect to the fuel flow.

11. The method of claim 9, wherein the flow management device includes a plurality of fingers and a plurality of spaces separating the plurality of fingers, the plurality of fingers and the plurality of spaces forming a plurality of channels for conveying the fuel flow.

12. The method of claim 11, wherein the plate has a plurality of through-holes formed therein, the plurality of through-holes being arranged such that the fuel flow passes through the plurality of through-holes, and wherein the adjusting step includes controlling to distribution of the fuel flow between the plurality of through-holes and the plurality of annulus areas of the plate.

13. The method of claim 11, wherein the size of the plurality of fingers and/or the size of the plurality of spaces is modified to adjust the effective size of the plurality of annulus areas.

14. A micromixer for mixing fuel and air in a gas turbine, comprising:

an inlet through which fuel enters a section of the micromixer;

a plate situated in the section and including a plurality of holes formed therein such that the fuel flows through the plurality of holes;

a plurality of mixing tubes extending through a first group of the plurality of holes to transport a fuel/air mixture to a reaction zone for ignition, the first group of plurality of holes forming a plurality of annulus areas between the plate and the plurality of mixing tubes, each mixing tube including, a plurality of fuel holes through which fuel enters the respective mixing tube;

a flow management device directly attached to the plurality of mixing tubes to control a flow rate of fuel flow through the first group of plurality of holes.

15. The micromixer of claim 14, wherein the plurality of fuel holes are arranged on a downstream side of the plate with respect to the fuel flow.

16. The micromixer of claim 14, wherein the flow management device includes a plurality of metering elements for controlling the flow rate of the fuel flow through the first group of the plurality of holes, and wherein the first group of the plurality of holes includes the entirety of the plurality of holes.

17. The micromixer of claim 16, wherein the metering elements include a plurality of fingers and a plurality of spaces separating the plurality of fingers, the plurality of fingers and the plurality of spaces forming a plurality of channels for conveying the fuel flow.

18. The micromixer of claim 17, wherein the size of the plurality of fingers and/or the size of the plurality of spaces is modified to control the flow rate of the fuel flow through the first group of the plurality of holes.

19. The micromixer of claim 17, wherein the fingers dampen vibration of the mixing tubes.

20. The micromixer of claim 14, wherein a second group of the plurality of holes includes a plurality of distribution holes configured such that the fuel flow passes through the plurality of distribution holes, wherein the flow management device includes a plurality of metering elements for controlling a distribution of the fuel flow between the plurality of annulus areas and the plurality of distribution holes.

21. The gas turbine combustor of claim 1, wherein the flow management device has at least one first portion engaging the plate and a plurality of second portions extending into the annulus areas formed between the plate and the mixing tube.

22. The method of claim 9, further comprising providing a flow management device to adjust the effective size of the annulus areas, the flow management device having at least one first portion engaging the plate and a plurality of second portions extending into the annulus areas formed between the plate and the mixing tubes.

23. The micromixer of claim 14, wherein the flow management device has at least one first portion engaging the plate and a plurality of second portions extending into the annulus areas formed between the plate and the mixing tubes.

* * * * *